US010830502B2

(12) United States Patent
Akaiwa et al.

(10) Patent No.: US 10,830,502 B2
(45) Date of Patent: Nov. 10, 2020

(54) AIR CONDITIONER

(71) Applicant: Mitsubishi Electric Corporation, Tokyo (JP)

(72) Inventors: Ryota Akaiwa, Tokyo (JP); Shinya Higashiiue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 68 days.

(21) Appl. No.: 16/324,770

(22) PCT Filed: Sep. 13, 2016

(86) PCT No.: PCT/JP2016/076968
§ 371 (c)(1),
(2) Date: Feb. 11, 2019

(87) PCT Pub. No.: WO2018/051408
PCT Pub. Date: Mar. 22, 2018

(65) Prior Publication Data
US 2019/0203981 A1 Jul. 4, 2019

(51) Int. Cl.
*F25B 13/00* (2006.01)
*F25B 41/04* (2006.01)
(Continued)

(52) U.S. Cl.
CPC ..... *F25B 13/00* (2013.01); *F25B 41/04* (2013.01); *F25B 41/062* (2013.01);
(Continued)

(58) Field of Classification Search
CPC ..... F25B 13/00; F25B 2313/0233; F25B 2313/02332; F25B 2313/02334;
(Continued)

(56) References Cited

U.S. PATENT DOCUMENTS 5,634,352 A * 6/1997 Nagai ..... F16K 11/065 62/324.6
9,052,125 B1 * 6/2015 Dostal ..... F25B 7/00
(Continued)

FOREIGN PATENT DOCUMENTS

JP 2009-085484 A 4/2009
JP 2015-117936 A 6/2015

OTHER PUBLICATIONS

International Search Report of the International Searching Authority dated Nov. 22, 2016 for the corresponding International application No. PCT/JP2016/076968 (and English translation).

*Primary Examiner* — Filip Zec
(74) *Attorney, Agent, or Firm* — Posz Law Group, PLC

(57) ABSTRACT

An air conditioner performs a heating operation and a cooling operation with enhanced heat exchange performance and also performs a heating continuous operation, while preventing increases in manufacturing cost and packaging volume. An air conditioner comprises a refrigerant circuit through which refrigerant circulates. A second heat exchanger includes a first refrigerant flow path and a second refrigerant flow path. A first port of the flow path switching device is connected to a discharge portion of a compressor. A second port is connected to a first heat exchanger. A third port is connected to an intake portion of the compressor. A fourth port is connected to a pipe that connects a branch point to the first refrigerant flow path. A fifth port is connected to the second refrigerant flow path. A sixth port is connected to the first refrigerant flow path.

11 Claims, 20 Drawing Sheets

(51) Int. Cl.
*F25B 47/02* (2006.01)
*F25B 41/06* (2006.01)

(52) U.S. Cl.
CPC .... *F25B 47/025* (2013.01); *F25B 2313/0233* (2013.01); *F25B 2313/0272* (2013.01); *F25B 2313/0276* (2013.01); *F25B 2313/02332* (2013.01); *F25B 2313/02334* (2013.01); *F25B 2313/02533* (2013.01); *F25B 2313/02541* (2013.01); *F25B 2313/02542* (2013.01); *F25B 2313/02741* (2013.01); *F25B 2600/2513* (2013.01)

(58) Field of Classification Search
CPC .. F25B 2313/02533; F25B 2313/02541; F25B 2313/02542; F25B 2313/0272; F25B 2313/02741; F25B 2313/0276; F25B 2600/2513; F25B 41/04; F25B 41/062; F25B 47/025
See application file for complete search history.

(56) References Cited

U.S. PATENT DOCUMENTS

2012/0118533 A1 5/2012 Jang et al.
2014/0311179 A1* 10/2014 Kojima ..... F16K 11/0746 62/467

* cited by examiner (A)

(B)

(C)

FLOW OF REFRIGERANT
DURING HEATING OPERATION (A)

(B)

(C)

FLOW OF REFRIGERANT
DURING COOLING OPERATION (A)

(B)

(C)

FLOW OF REFRIGERANT DURING HEATING OPERATION INCLUDING DEFROSTING OF OUTDOOR HEAT EXCHANGER 3a (A)

(B)

(C)

FLOW OF REFRIGERANT DURING HEATING OPERATION INCLUDING DEFROSTING OF OUTDOOR HEAT EXCHANGER 3b

AIR CONDITIONER

CROSS REFERENCE TO RELATED APPLICATION

This application is a U.S. national stage application of International Application PCT/JP2016/076968, filed on Sep. 13, 2016, the contents of which are incorporated herein by reference.

TECHNICAL FIELD

The present invention relates to an air conditioner, and more particularly to an air conditioner whose operational status is switchable among a heating operation, a cooling operation, and a heating continuous operation.

BACKGROUND

Generally, when a heat exchanger is used for cooling air in heat pump equipment (e.g. air conditioning equipment) and a car air conditioner, the heat exchanger is called a vaporizer or an evaporator. In this case, refrigerant (e.g. fluorocarbon refrigerant) flows in the heat exchanger in the state of a gas-liquid two-phase flow, that is, a mixture of gas refrigerant and liquid refrigerant whose densities differ by tens of times. Mainly the liquid refrigerant in the incoming refrigerant in the state of a gas-liquid two-phase flow (two-phase refrigerant) absorbs heat from air to vaporize and changes its phase into gas refrigerant. Thus, it turns into gas single-phase refrigerant and flows out of the heat exchanger. The air, on the other hand, becomes cool by losing the heat as described above.

When a heat exchanger is used for heating air, the heat exchanger is called a condenser. In this case, gas single-phase refrigerant discharged from a compressor, which is high-temperature and high-pressure, flows in the heat exchanger. The gas single-phase refrigerant that has flowed in the heat exchanger turns into supercooled liquid single-phase refrigerant by latent heat and sensible heat (the latent heat is the heat provided when heat is absorbed by the air and the refrigerant thus condenses and changes its phase into liquid single-phase refrigerant, and the sensible heat is the heat provided when the liquefied single-phase refrigerant is supercooled). The supercooled liquid single-phase refrigerant then flows out of the heat exchanger. The air, on the other hand, becomes warm by absorbing the heat.

In the conventional heat pump, the heat exchanger is designed for use in both of the above-described vaporizer and the above-described condenser by a plain cycle operation and a reverse cycle operation in which refrigerant flows in the reverse direction. Accordingly, if refrigerant flows in a plurality of refrigerant flow paths in parallel in the heat exchanger by dividing the refrigerant flow path into three branches for example, the refrigerant flows typically in parallel in the heat exchanger in both cases in which the heat exchanger is used as a vaporizer and as a condenser.

However, when the heat exchanger is used as a condenser, using the heat exchanger with a decreased number of branches of refrigerant flow path and with a high refrigerant flow velocity is effective to exhibit the full performance of the heat exchanger. When the heat exchanger is used as a vaporizer, on the other hand, using the heat exchanger with an increased number of branches of refrigerant flow and with a low refrigerant flow velocity is effective. This is because the heat transfer, which depends on the refrigerant flow velocity, governs the performance for the condenser; whereas reduction in pressure loss, which depends on the refrigerant flow velocity, governs the performance for the vaporizer.

As a technique for a heat exchanger to have the characteristics of a vaporizer and a condenser, for example, Japanese Patent Laying-Open No. 2015-117936 (PTL 1) proposes an air conditioner that includes a flow path switching unit. The flow path switching unit can switch between the state in which the heat exchanger is used as a vaporizer, where refrigerant flows through a plurality of flow paths (first flow path and second flow path) in parallel; and the state in which the heat exchanger is used as a condenser, where refrigerant flows through a plurality of flow paths in series.

In recent years, models of air conditioners having not only energy-saving features but also new additional features have been developed into products, and the competition in additional features, instead of energy-saving features, has been intensified. One of such additional features is a heating continuous operation as described in, for example, Japanese Patent Laying-Open No. 2009-85484 (PTL 2).

For example, when it is cold and a heating operation is performed using a heat-pumping air-conditioning outdoor unit for both cooling and heating, the surface temperatures of fins and heat exchanger tubes in the vaporizer of the outdoor unit drops to a below-freezing temperature. This causes a phenomenon in which water in the air forms into frost on the surfaces of the fins and the heat exchanger tubes. Occurrence of such a frost formation phenomenon significantly increases the ventilation resistance of the air passing among the fins of the vaporizer and increases the thermal resistance during heat exchange between the fins and the air. As a result, the heat exchange efficiency decreases.

In a conventional heat-pumping air-conditioning outdoor unit for both cooling and heating, when the heat exchange efficiency has dropped by a certain level or more due to the above-described frost formation phenomenon, a defrosting operation is started. The defrosting operation is an operation state in which the flow of the refrigeration cycle, which functions as a vaporizer, is stopped, and in which a refrigerant flow is restarted in the reverse direction, thus causing high-temperature gas refrigerant discharged from a compressor to flow in the air-conditioning outdoor unit. In this case, the frost that has adhered to the fins of the air-conditioning outdoor unit melts into water by absorbing heat from the high-temperature gas refrigerant via the fins. In the heating continuous operation (also referred to as a heating-defrosting operation), a part of the heat exchanger is used as a vaporizer, and the remaining part is used in the defrosting operation state. Thus, the heating operation is continued while defrosting is performed.

The heating continuous operation allows room heating to continue while a defrosting operation is performed. Therefore, comfort can be maintained with no sudden temperature change in the room.

PATENT LITERATURE

PTL 1: Japanese Patent Laying-Open No. 2015-117936

PTL 2: Japanese Patent Laying-Open No. 2009-85484

However, the technique described in PTL 1, in which the number of refrigerant flow paths in the heat exchanger is increased and decreased, and the technique described in PTL 2, which enables the heating continuous operation, are disadvantageous because they require a device for switching between a plurality of refrigerant flow paths on the refrigerant circuit and thus involves increases in manufacturing cost and packaging volume.

SUMMARY

An object of the present invention is to provide an air conditioner that can perform a heating operation and a cooling operation with enhanced heat exchange performance and can also perform a heating continuous operation, while preventing increases in manufacturing cost and packaging volume.

An air conditioner according to the present invention comprises a refrigerant circuit through which refrigerant circulates. The refrigerant circuit includes a compressor, a first heat exchanger, an expansion valve, a second heat exchanger, and a flow path switching device. The second heat exchanger includes a first refrigerant flow path and a second refrigerant flow path. The compressor includes an intake portion and a discharge portion. The first refrigerant flow path and the second refrigerant flow path are connected in parallel to the first heat exchanger via a branch point. The flow path switching device includes first to sixth ports. The first port is connected to the discharge portion of the compressor. The second port is connected to the first heat exchanger. The third port is connected to the intake portion of the compressor. The fourth port is connected to a pipe that connects the branch point to the first refrigerant flow path. The fifth port is connected to the second refrigerant flow path. The sixth port is connected to the first refrigerant flow path. In the flow path switching device, a connection target of the second port is switchable between the first port and the third port. A connection target of the fifth port is switchable among the first port, the third port, and the fourth port. A connection target of the sixth port is switchable between the first port and the third port.

An air conditioner according to the present invention can perform a heating operation, a cooling operation, and a heating continuous operation using a single flow path switching device. This achieves reduction in volume and cost of an air conditioner that can perform a heating operation and a cooling operation with enhanced heat exchange performance and can also perform a heating continuous operation.

DETAILED DESCRIPTION

Figure 1:
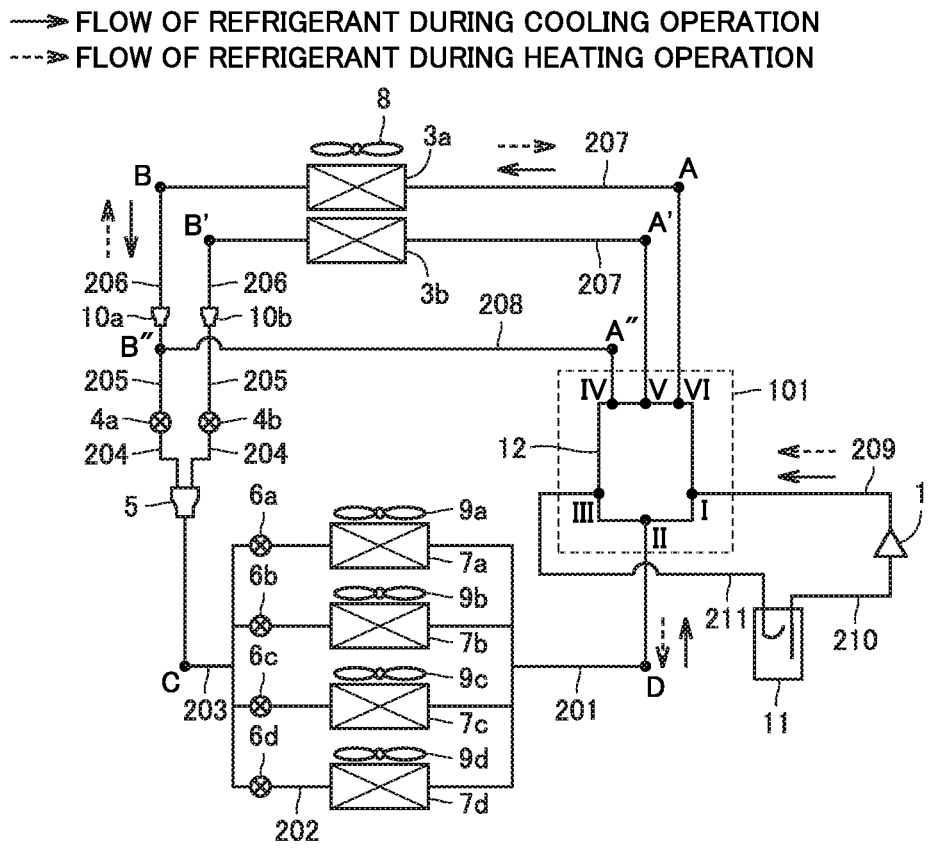
FIG. 1 is a configuration diagram of an air conditioner according to embodiment 1 of the present invention.

Embodiments of the present invention are described hereinafter with reference to the drawings. In the drawings described hereinafter, identical or corresponding parts are identically denoted, and the explanation of such parts is not repeated. In the drawings described hereinafter, including FIG. 1, the relationship between the constituent members in terms of size may not be the same as that of the actual one. Further, the modes of the constituent elements described in the entire specification are merely by way of example, and they are not limited to the description.

Embodiment 1

<Configuration of Air Conditioner>

FIG. 1 shows a configuration diagram of an air conditioner as a refrigeration cycle apparatus in the present embodiment. The following describes the configuration in the present embodiment by taking, as an example, an air conditioner including a plurality of indoor units for a single outdoor unit, such as a multi air conditioning system for buildings.

The air conditioner includes a refrigerant circuit through which refrigerant circulates. The refrigerant circuit includes a compressor 1, indoor heat exchangers 7*a* to 7*d* as a first heat exchanger, indoor fans 9*a* to 9*d* as a fan, expansion valves 6*a* to 6*d*, a three-way tube 5, expansion valves 4*a*, 4*b* as an on-off valve, refrigerant distributors 10*a*, 10*b*, a second heat exchanger (outdoor heat exchangers 3*a*, 3*b*), an outdoor fan 8 as a fan, and a flow path switching device 12. For example, during a heating operation, refrigerant flows through compressor 1, flow path switching device 12, indoor heat exchangers 7*a* to 7*d*, expansion valves 6*a* to 6*d*, three-way tube 5, expansion valves 4*a*, 4*b*, the second heat exchanger, and flow path switching device 12, in this order in the above-described refrigerant circuit. The second heat exchanger includes outdoor heat exchanger 3*a* as a first refrigerant flow path and outdoor heat exchanger 3*b* as a second refrigerant flow path. Compressor 1 includes an intake portion and a discharge portion. Outdoor heat exchanger 3*a* and outdoor heat exchanger 3*b* are connected in parallel to indoor heat exchangers 7*a* to 7*d* via three-way tube 5 as a branch point. Expansion valve 4*a* as the above-described on-off valve is connected between three-way tube 5 and outdoor heat exchanger 3*a* (first refrigerant flow path) via pipes 204 to 206. From a different viewpoint, on pipes 204 to 206, expansion valve 4*a* is placed between connection point B" connected to fourth port IV, and three-way tube 5 as a branch point. The above-described air conditioner may be configured with no expansion valves 6*a* to 6*d*.

Flow path switching device 12 that constitutes refrigerant flow path switching circuit 101 includes first to sixth ports. First port I is connected to the discharge portion of compressor 1 via pipe 209. Second port II is connected to indoor heat exchangers 7*a* to 7*d* via pipe 201. Third port III is connected to the intake portion of compressor 1 via pipes 210, 211 and an accumulator 11. Accumulator 11 is disposed between third port III and the intake portion of compressor 1. Fourth port IV is connected to connection point B" via pipe 208, connection point B" being on pipe 205 between three-way tube 5 as a branch point and outdoor heat exchanger 3*a* (first refrigerant flow path). Fifth port V is connected to outdoor heat exchanger 3*b* (second refrigerant flow path) via pipe 207. Sixth port VI is connected to outdoor heat exchanger 3*a* (first refrigerant flow path) via pipe 207.

Indoor heat exchangers 7*a* to 7*d* are respectively connected to expansion valves 6*a* to 6*d* via respective pipes 202. Expansion valves 6*a* to 6*d* are connected to three-way tube 5 via pipe 203. Three-way tube 5 is connected to expansion valves 4*a*, 4*b* via pipes 204. Expansion valve 4*a* is connected to refrigerant distributor 10*a* via pipe 205. Pipe 205 has connection point B" at which pipe 205 and pipe 208 are connected. Refrigerant distributor 10*a* is connected to outdoor heat exchanger 3*a* via pipe 206. Expansion valve 4*b* is connected to refrigerant distributor 10*b* via pipe 205. Refrigerant distributor 10*b* is connected to outdoor heat exchanger 3*b* via pipe 206.

As described later, in flow path switching device 12, the connection target of second port II is switchable between first port I and third port III. The connection target of fifth port V is switchable among first port I, third port III, and fourth port IV. The connection target of sixth port VI is switchable between first port I and third port III.

<Operation and Advantageous Effects of Air Conditioner>

During a cooling operation, refrigerant flows through the refrigerant circuit in the direction indicated by the solid line arrows in FIG. 1. During a heating operation, refrigerant flows through the refrigerant circuit in the direction indicated by the broken line arrows in FIG. 1. The operation of the air conditioner in each operation state is hereinafter described.

Figure 2:
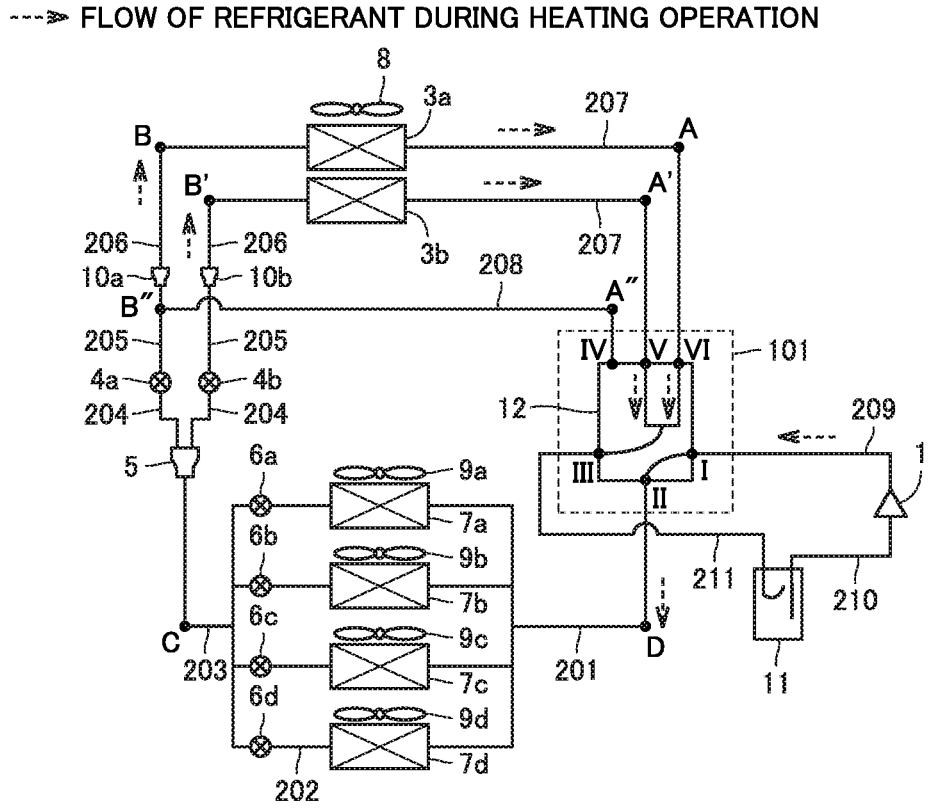
FIG. 2 is a schematic diagram showing a refrigerant flow during a heating operation in embodiment 1 of the present invention.
Figure 3:
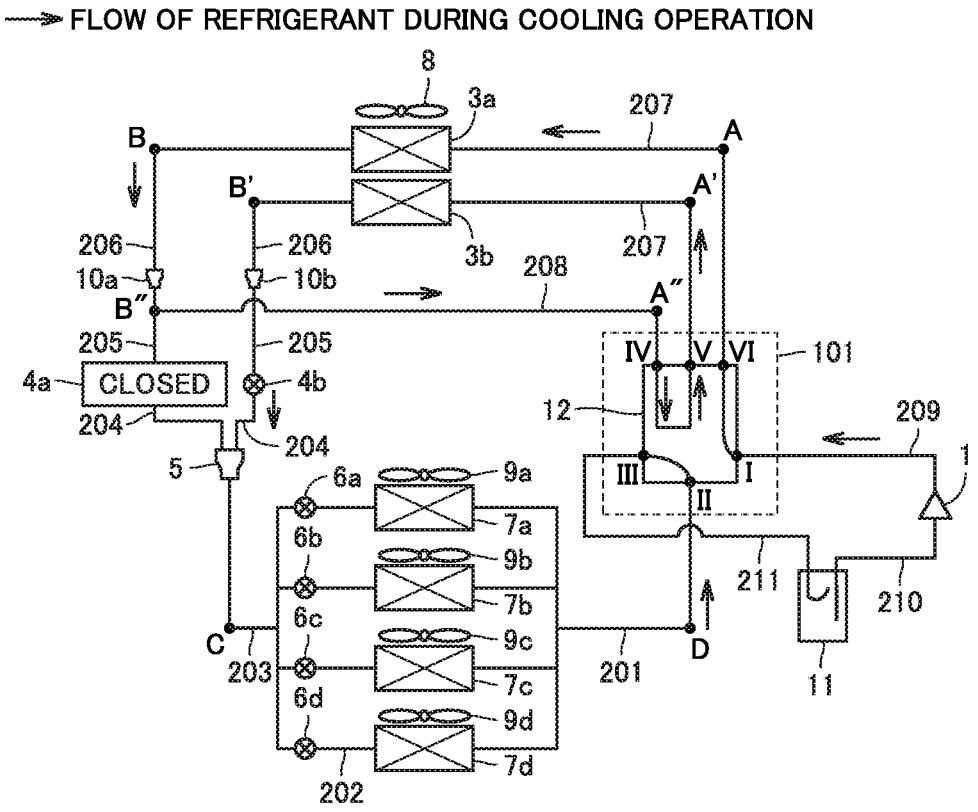
FIG. 3 is a schematic diagram showing a refrigerant flow during a cooling operation in embodiment 1 of the present invention.
Figure 4:
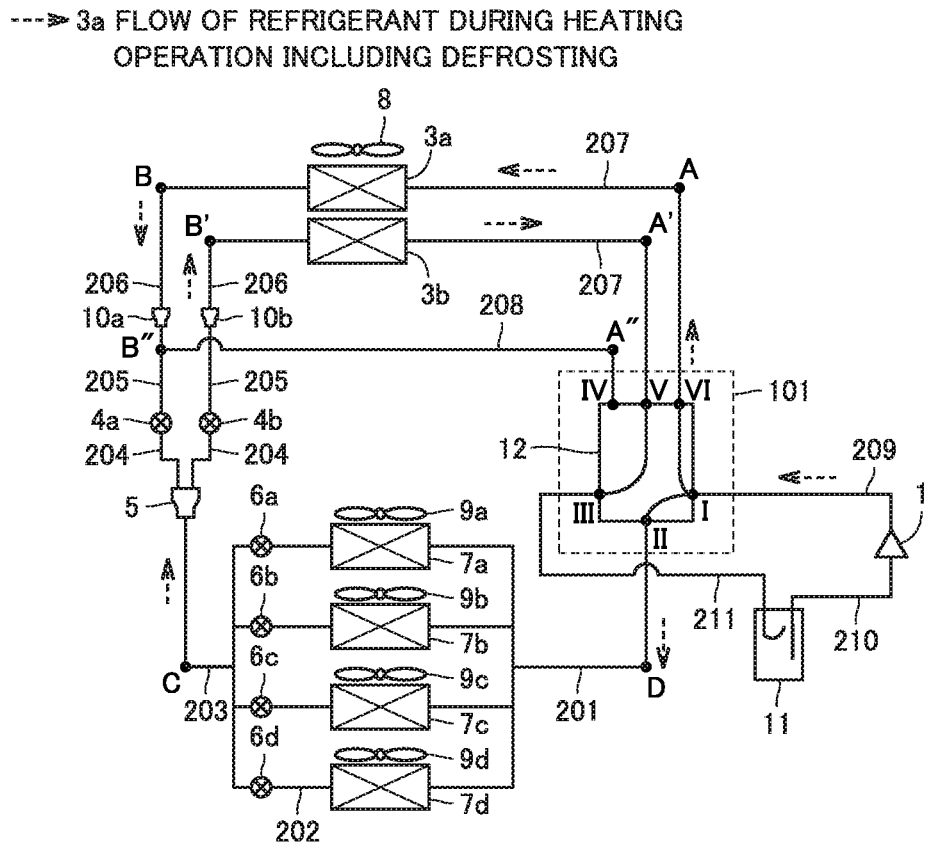
FIG. 4 is a schematic diagram showing a refrigerant flow (pattern 1) during a heating continuous operation in embodiment 1 of the present invention.
Figure 5:
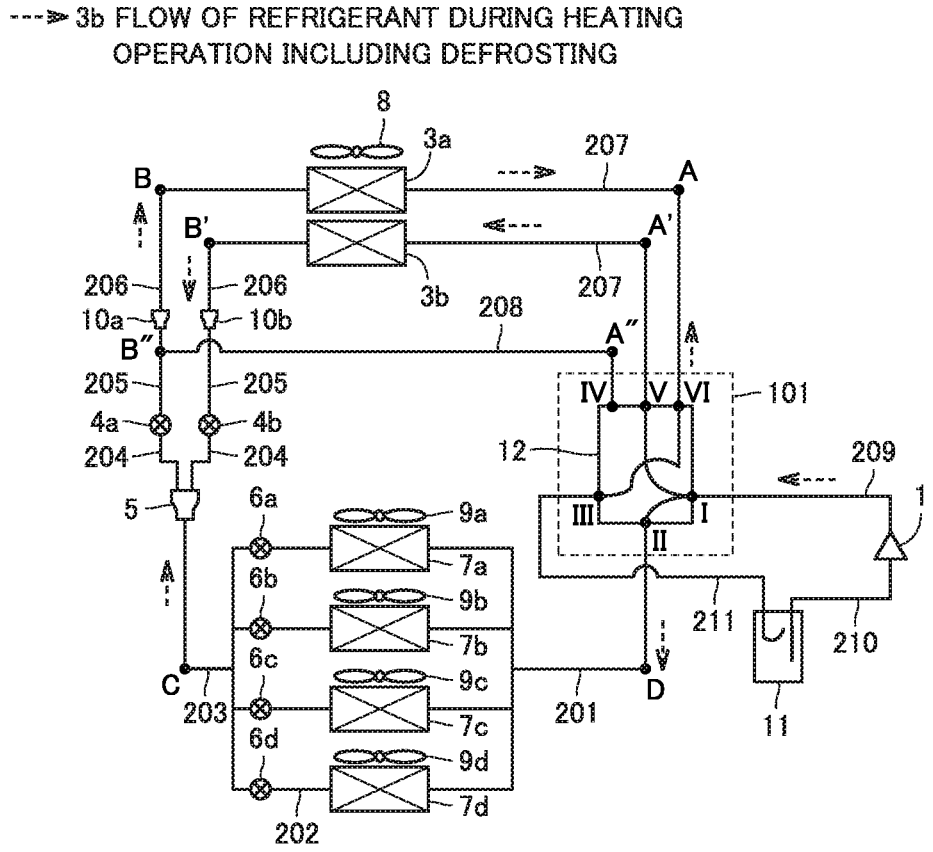
FIG. 5 is a schematic diagram showing a refrigerant flow (pattern 2) during a heating continuous operation in embodiment 1 of the present invention.

FIG. 2 is a schematic diagram showing a flow of refrigerant during a heating operation. FIG. 3 is a schematic diagram showing a flow of refrigerant during a cooling operation. FIG. 4 and FIG. 5 are schematic diagrams showing refrigerant flows during a heating continuous operation (pattern 1 and pattern 2).

(1) During Heating Operation

As shown in FIG. 2, during a heating operation, the gas refrigerant compressed at compressor 1, which is high-temperature and high-pressure, flows in first port I of flow path switching device 12. In flow path switching device 12, a flow path that connects first port I to second port II is formed. Thus, the gas refrigerant that has passed through second port II of flow path switching device 12 reaches point D on pipe 201. The gas refrigerant then branches and passes through a plurality of indoor heat exchangers 7*a* to 7*d*. At this time, each of indoor heat exchangers 7*a* to 7*d* serves as a condenser. Therefore, the gas refrigerant in indoor heat exchangers 7*a* to 7*d* is cooled and liquefied by the air supplied to indoor heat exchangers 7*a* to 7*d* by indoor fans 9*a* to 9*d*. The air heated by the heat from the gas refrigerant in indoor heat exchangers 7*a* to 7*d* is supplied to the indoor space that should be heated.

The liquefied liquid refrigerant passes through expansion valves 6*a* to 6*d*, thereby becoming a two-phase refrigerant state in which low-temperature, low-pressure gas refrigerant and liquid refrigerant are mixed. The refrigerant then reaches point C on pipe 203. The refrigerant in the two-phase refrigerant state (also referred to as two-phase refrigerant) then passes through three-way tube 5, divides into two branches, and passes through two pipes 204. The two branches of the two-phase refrigerant flow in refrigerant distributors 10*a*, 10*b* respectively through expansion valves 4*a*, 4*b*. The refrigerant then reaches point B and point B' on respective pipes 206.

To connection point B", which lies between expansion valve 4*a* and refrigerant distributor 10*a*, pipe 208 is connected. Pipe 208 passes point A" by bypassing outdoor heat exchanger 3*a* and leads to fourth port IV of flow path switching device 12 that constitutes refrigerant flow path switching circuit 101. However, since flow path switching device 12 does not have a flow path that connects with fourth port IV, a flow of refrigerant is not generated from connection point B" toward point A".

The two-phase refrigerant that has passed through point B and point B' respectively flows through outdoor heat exchangers 3*a*, 3*b* disposed in parallel. Each of outdoor heat exchangers 3*a*, 3*b* serves as a vaporizer. In outdoor heat exchangers 3*a*, 3*b*, the two-phase refrigerant is heated by the air blown by outdoor fan 8. As a result, the gasified refrigerant reaches point A and point A' on pipes 207. The gas refrigerant that has passed through point A and point A' respectively flows in sixth port VI and fifth port V of flow path switching device 12.

In flow path switching device 12 that constitutes refrigerant flow path switching circuit 101, a flow path that connects both sixth port VI and fifth port V to third port III is formed. Therefore, the gas refrigerant supplied to sixth port VI and fifth port V is supplied to accumulator 11 through third port III. The gas refrigerant then returns to compressor 1 via accumulator 11. By this cycle, a heating operation to heat the indoor air is performed.

The above description is summarized as follows. The above-described air conditioner is operable in a heating operation state as a first operation state. In the heating operation state, expansion valve 4*a* as an on-off valve is in an open state. In the heating operation state, first port I is connected to second port II, and fifth port V and sixth port VI are connected to third port III in flow path switching device 12. This allows the refrigerant to flow in parallel with respect to outdoor heat exchangers 3*a*, 3*b*, which serve as vaporizers. Accordingly, the pressure loss, which depends on the refrigerant flow velocity, can be decreased by reducing the refrigerant flow velocity. As a result, each heat exchanger can exhibit good performance as a vaporizer.

(2) During Cooling Operation

Next, a flow of refrigerant during a cooling operation shown in FIG. 3 is described. The gas refrigerant compressed at compressor 1, which is high-temperature and high-pressure, flows in first port I of flow path switching device 12. In flow path switching device 12 that constitutes refrigerant flow path switching circuit 101, a flow path that connects first port I to sixth port VI is formed. Thus, the gas refrigerant reaches point A on pipe 207. The gas refrigerant then flows in outdoor heat exchanger 3*a*. Outdoor heat exchanger 3*a* serves as a condenser. The gas refrigerant is cooled at outdoor heat exchanger 3*a* by the air blown by outdoor fan 8. Thus, the gas refrigerant changes its phase into a two-phase refrigerant state in which gas refrigerant and liquid refrigerant are mixed, or into a single-phase state of liquid refrigerant. The refrigerant then reaches point B on pipe 206.

The two-phase refrigerant or liquid refrigerant that has passed through point B reaches connection point B" on pipe 205 via refrigerant distributor 10*a*. Here, expansion valve 4*a* as an on-off valve is closed, and thus a flow of refrigerant is consequently led from connection point B" to point A" on pipe 208. As a result, the refrigerant reaches fourth port IV of flow path switching device 12 that constitutes refrigerant flow path switching circuit 101. In flow path switching device 12, a flow path that connects fourth port IV to fifth port V is formed. Thus, the refrigerant (two-phase refrigerant or liquid refrigerant) reaches point A' on pipe 207. The refrigerant then flows in outdoor heat exchanger 3*b*. In this outdoor heat exchanger 3*b*, the refrigerant is again cooled by the air blown by outdoor fan 8 and becomes supercooled liquid single-phase refrigerant. The refrigerant then reaches point B' on pipe 206.

As described above, the refrigerant passes through outdoor heat exchangers 3*a*, 3*b* in series when flowing from point A to point B'. The liquid refrigerant that has passed through point B' on pipe 206 reaches point C on pipe 203 via refrigerant distributor 10*b*, expansion valve 4*b*, and three-way tube 5. The liquid refrigerant that has passed through point C branches and passes through a plurality of expansion valves 6*a* to 6*d*, thereby becoming a two-phase refrigerant state in which low-temperature, low-pressure gas refrigerant and liquid refrigerant are mixed. The refrigerant in the two-phase refrigerant state passes through a plurality of indoor heat exchangers 7*a* to 7*d*. At this time, each of indoor heat exchangers 7*a* to 7*d* serves as a vaporizer. Thus, in heat exchangers 7*a* to 7*d*, the liquid refrigerant in the two-phase refrigerant is vaporized and gasified by the air blown by indoor fans 9*a* to 9*d*. The flows of gasified refrigerant join together, and the joined refrigerant reaches point D on pipe 201 and flows in second port II of flow path switching device 12. In flow path switching device 12 that constitutes refrigerant flow path switching circuit 101, a flow path that connects second port II to third port III is formed. This allows the gasified refrigerant (gas refrigerant) to pass through third port III to flow out of refrigerant flow path switching circuit 101. The gas refrigerant returns to compressor 1 via accumulator 11. By this cycle, a cooling operation to cool the indoor air is performed.

The above description is summarized as follows. The above-described air conditioner is operable in a cooling operation state as a second operation state. In the cooling operation state, expansion valve 4*a* as an on-off valve is in a closed state. In the cooling operation state, first port I is connected to sixth port VI, second port II is connected to third port III, and fourth port IV is connected to fifth port V in flow path switching device 12. Accordingly, when outdoor heat exchangers 3*a*, 3*b* are used as condensers, it is possible to decrease the number of branches of refrigerant flow path with the refrigerant in series flowing through outdoor heat exchangers 3*a*, 3*b*, thus allowing for a high flow velocity of refrigerant at outdoor heat exchangers 3*a*, 3*b*. As a result, each of outdoor heat exchangers 3*a*, 3*b* can exhibit good performance as a condenser.

As described above, in the air conditioner according to the present embodiment, outdoor heat exchangers 3*a*, 3*b* can exhibit good performance in both the heating operation and the cooling operation. Thus, the status of branch of flow path in the refrigerant circuit can be switched in accordance with the function exhibited by the heat exchangers, thus enhancing the heat exchange efficiency.

(3) During Heating Continuous Operation (Heating-Defrosting Operation)

Next, a flow of refrigerant during a heating continuous operation shown in FIG. 4 (pattern 1) is described. In a heating continuous operation corresponding to a third operation state shown in FIG. 4, the gas refrigerant compressed at compressor 1, which is high-temperature and high-pressure, flows in first port I of flow path switching device 12. In flow path switching device 12 that constitutes refrigerant flow path switching circuit 101, flow paths that connect first port I to second port II and sixth port VI are formed. Thus, the gas refrigerant that has flowed in first port I reaches point D on pipe 201 and point A on pipe 207. The gas refrigerant that has passed through point D then branches and passes through a plurality of indoor heat exchangers 7*a* to 7*d*. At this time, each of indoor heat exchangers 7*a* to 7*d* serves as a condenser. In indoor heat exchangers 7*a* to 7*d*, the gas refrigerant is cooled and liquefied by the air blown by indoor fans 9*a* to 9*d*. The liquefied refrigerant (liquid refrigerant) passes through expansion valves 6*a* to 6*d*, thereby becoming a two-phase refrigerant state in which low-temperature, low-pressure gas refrigerant and liquid refrigerant are mixed. The refrigerant in the two-phase refrigerant state (two-phase refrigerant) then passes through point C on pipe 203 and reaches three-way tube 5.

On the other hand, the gas refrigerant that has passed through point A flows in outdoor heat exchanger 3*a*. Outdoor heat exchanger 3*a* serves as a condenser. In outdoor heat exchanger 3*a*, the gas refrigerant is cooled by the air blown by outdoor fan 8 and changes its phase into a two-phase refrigerant state in which gas refrigerant and liquid refrigerant are mixed, or into a single-phase state of liquid refrigerant. The refrigerant that has changed its phase passes through point B on pipe 206, then through refrigerant distributor 10*a* and point B", and reaches expansion valve 4*a*. At this time, by passing through expansion valve 4*a*, the refrigerant becomes a two-phase refrigerant state in which low-temperature, low-pressure gas refrigerant and liquid refrigerant are mixed. The refrigerant then reaches three-way tube 5.

The two-phase refrigerant that has flowed in three-way tube 5 through point D and point C, and the two-phase refrigerant that has flowed in three-way tube 5 through point A and point B join together. The joined two-phase refrigerant flows from three-way tube 5 to expansion valve 4*b*. The two-phase refrigerant then flows through refrigerant distributor 10*b* and point B' to outdoor heat exchanger 3*b*. Outdoor heat exchanger 3*b* serves as a vaporizer. In outdoor heat exchanger 3*b*, the two-phase refrigerant is heated and gasified by the air blown by outdoor fan 8. The gasified refrigerant then reaches point A'. The gas refrigerant that has passed through point A' flows in fifth port V of flow path switching device 12. In flow path switching device 12 that constitutes refrigerant flow path switching circuit 101, a flow path that connects fifth port V to third port III is formed. The gas refrigerant passes through third port III and flows out of refrigerant flow path switching circuit 101 to pipe 211. The gas refrigerant then returns to compressor 1 via accumulator 11.

The above description is summarized as follows. The above-described air conditioner is operable in a heating continuous operation state (pattern 1) as a third operation state. In the heating continuous operation state (pattern 1), expansion valve 4*a* as an on-off valve is in an open state. In flow path switching device 12, first port I is connected to second port II and sixth port VI, and third port III is connected to fifth port V.

By this cycle, a heating operation to heat the indoor air is performed. Further, a flow of high-temperature, high-pressure refrigerant through outdoor heat exchanger 3*a*, among outdoor heat exchangers 3*a*, 3*b*, prevents water in the outside air from forming dew or frost at outdoor heat exchanger 3*a*. Even if water in the air has formed frost at outdoor heat exchanger 3*a*, the frost can be removed by heating.

Next, a flow of refrigerant during a heating continuous operation shown in FIG. 5 (pattern 2) is described. In the heating continuous operation corresponding to a fourth operation state shown in FIG. 5, a flow of refrigerant is basically the same as that of FIG. 4 described above. However, it is different from the above-described refrigerant flow shown in FIG. 4 in that outdoor heat exchanger 3*a* and outdoor heat exchanger 3*b* are interchanged with each other in terms of the function and the flow of refrigerant. That is, in the heating continuous operation shown in FIG. 5, flow paths that connect first port I to second port II and fifth port V are formed, and a flow path that connects sixth port VI to third port III is formed, in flow path switching device 12 that constitutes refrigerant flow path switching circuit 101 in FIG. 4. The above description is summarized as follows. The above-described air conditioner is operable in a heating continuous operation state (pattern 2) as a fourth operation state. In the heating continuous operation state (pattern 2), expansion valve 4*a* as an on-off valve is in an open state. In flow path switching device 12, first port I is connected to second port II and fifth port V, and third port III is connected to sixth port VI.

With such a configuration, a heating operation to heat the indoor air is performed. Further, a flow of high-temperature, high-pressure refrigerant through outdoor heat exchanger 3*b*, among outdoor heat exchangers 3*a*, 3*b*, prevents water in the outside air from forming dew or frost at outdoor heat exchanger 3*b*. Even if water in the air has formed frost at outdoor heat exchanger 3*b*, the frost can be removed by heating.

In the heating continuous operation, the heating continuous operation shown in FIG. 4 (pattern 1) and the heating continuous operation shown in FIG. 5 (pattern 2) as described above are repeatedly switched with each other and alternately performed. Accordingly, if frost is formed at either one of outdoor heat exchangers 3*a*, 3*b*, it can be removed during operation in either pattern 1 or pattern 2. In the operation, therefore, both of outdoor heat exchangers 3*a*, 3*b* can exhibit sufficient performance as vaporizers. Thus, the heating operation to heat the indoor air can be continuously maintained.

From the foregoing, in the air conditioner according to the present embodiment, refrigerant flow path switching circuit 101 allows for an efficient heating operation, cooling operation, and heating continuous operation. That is, an outdoor heat exchanger in heat pump equipment, such as an air conditioner according to the present embodiment, includes a plurality of refrigerant flow paths (outdoor heat exchangers 3*a*, 3*b*). With respect to the plurality of refrigerant flow paths, the outdoor heat exchanger allows refrigerant to flow in parallel during a heating operation, and allows refrigerant to flow in series during a cooling operation. Further, during a heating continuous operation (heating-defrosting simultaneous operation), the above-described outdoor heat exchanger allows refrigerant to flow so that a part of the outdoor heat exchanger (e.g. outdoor heat exchanger 3*a* as one refrigerant flow path) performs a defrosting operation, while the remaining part of the outdoor heat exchanger (e.g. outdoor heat exchanger 3*b* as another refrigerant flow path) serves as a vaporizer. Such a heating operation, cooling operation, and heating continuous operation can be provided by a simple circuit.

<Example Configuration of Flow Path Switching Device>

Figure 6:
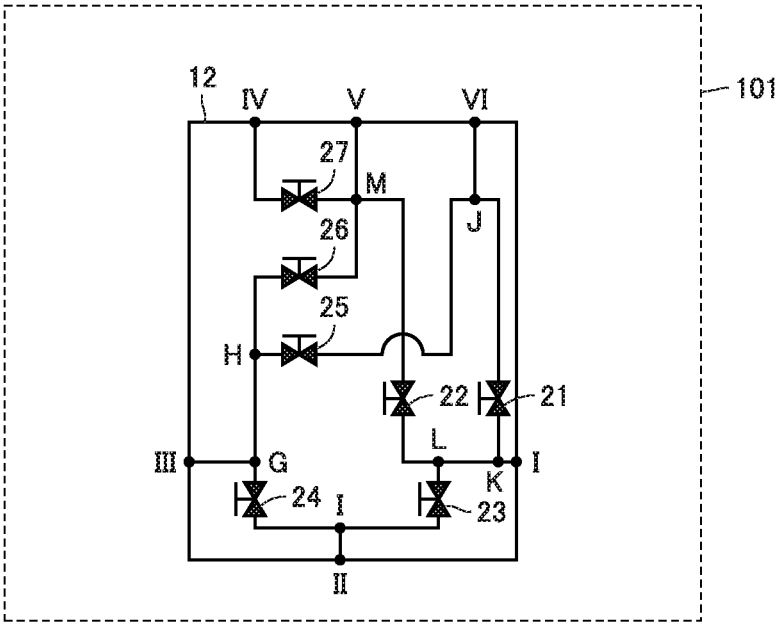
FIG. 6 is a configuration diagram of a flow path switching device that constitutes a flow path switching circuit in embodiment 1 of the present invention.

Next, an example configuration of flow path switching device 12 that constitutes refrigerant flow path switching circuit 101 in the present embodiment is described. Flow path switching device 12 may be configured with a combination of the refrigerant flow path as shown in FIG. 6 and, for example, a plurality of openable and closable solenoid valves 21 to 27. Specific explanation is given below.

Flow path switching device 12 shown in FIG. 6 includes first to sixth ports I to VI formed on a casing, pipes that connect first to sixth ports I to VI with each other, and a plurality of solenoid valves 21 to 27 as three or more openable and closable valves placed on the pipes. First port I is connected to sixth port VI with pipes via point K, solenoid valve 21, and point J. Also, first port I is connected to second port II with pipes via point K, point L, solenoid valve 23, and point I. Second port II is connected to third port III with pipes via point I, solenoid valve 24, and point G. Third port III is connected to sixth port VI with pipes via point G, point H, solenoid valve 25, and point J. Third port III is connected to fifth port V with pipes via point G, point H, solenoid valve 26, and point M. Fourth port IV is connected to first port I with pipes via solenoid valve 27, point M, solenoid valve 22, point L, and point K.

The operation status (open/closed state) of each of solenoid valves 21 to 27 that constitute flow path switching device 12 shown in FIG. 6 is shown in Table 1 for each operational condition.

TABLE 1

| | Heating Operation | Cooling Operation | Heating Continuos Operation (Pattern 1) | Heating Continuous Operation (Pattern 2) |
|---|---|---|---|---|
| Solenoid Valve 21 | Closed | Open | Open | Closed |
| Solenoid Valve 22 | Closed | Closed | Closed | Open |
| Solenoid Valve 23 | Open | Closed | Open | Open |
| Solenoid Valve 24 | Closed | Open | Closed | Closed |
| Solenoid Valve 25 | Open | Closed | Closed | Open |
| Solenoid Valve 26 | Open | Closed | Open | Closed |
| Solenoid Valve 27 | Closed | Open | Closed | Closed |

Using flow path switching device 12 having such a configuration, the operation states shown in FIG. 2 to FIG. 5 can be provided.

Embodiment 2

<Configuration of Air Conditioner>

Figure 7:
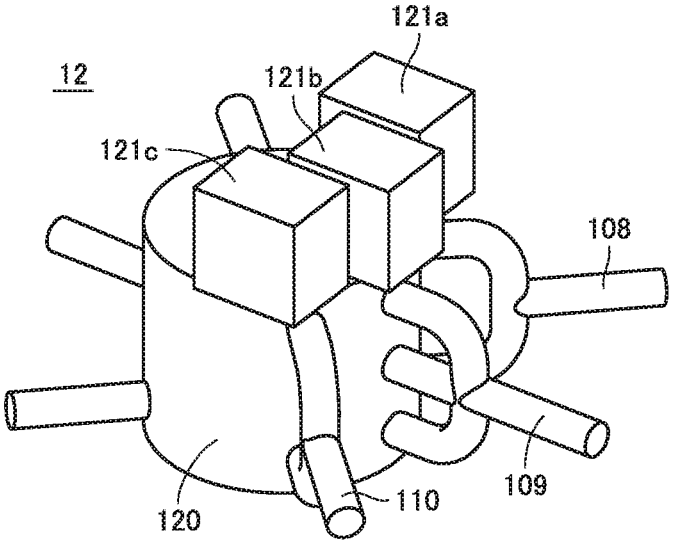
FIG. 7 is a perspective schematic view of a flow path switching device that constitutes a flow path switching circuit in embodiment 2 of the present invention.
Figure 8:
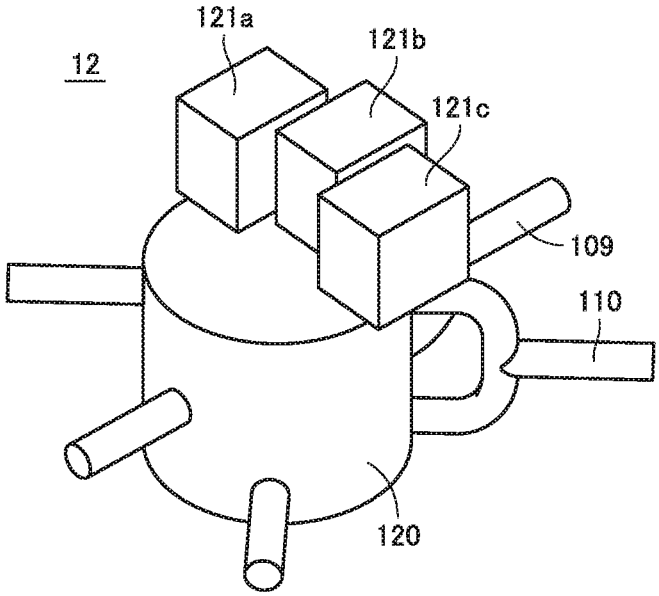
FIG. 8 is a perspective schematic view of a flow path switching device that constitutes a flow path switching circuit in embodiment 2 of the present invention.
Figure 9:
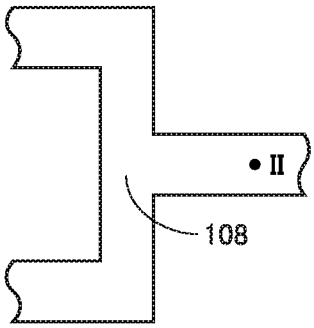
FIG. 9 is a schematic diagram of a branch flow path 108 included in a flow path switching device in embodiment 2 of the present invention.
Figure 10:
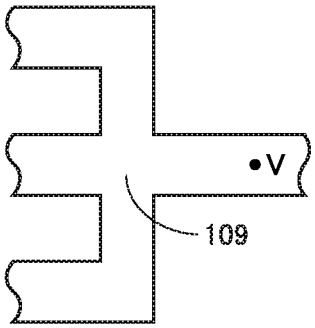
FIG. 10 is a schematic diagram of a branch flow path 109 included in a flow path switching device in embodiment 2 of the present invention.
Figure 11:
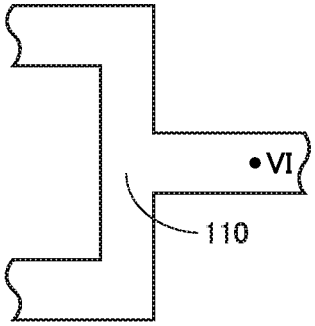
FIG. 11 is a schematic diagram of a branch flow path 110 included in a flow path switching device in embodiment 2 of the present invention.
Figure 12:
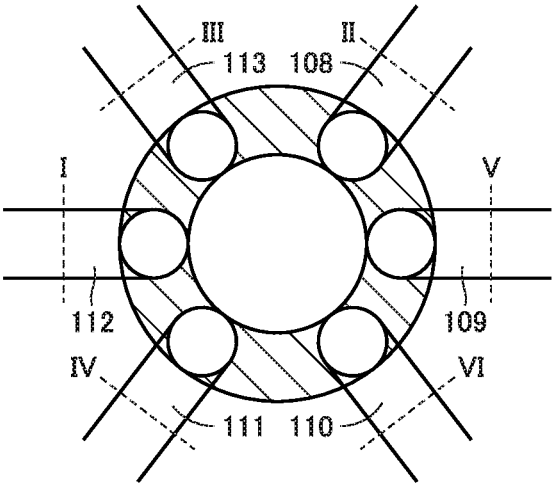
FIG. 12 is a transverse sectional schematic diagram of a flow path switching device in embodiment 2 of the present invention.
Figure 13:
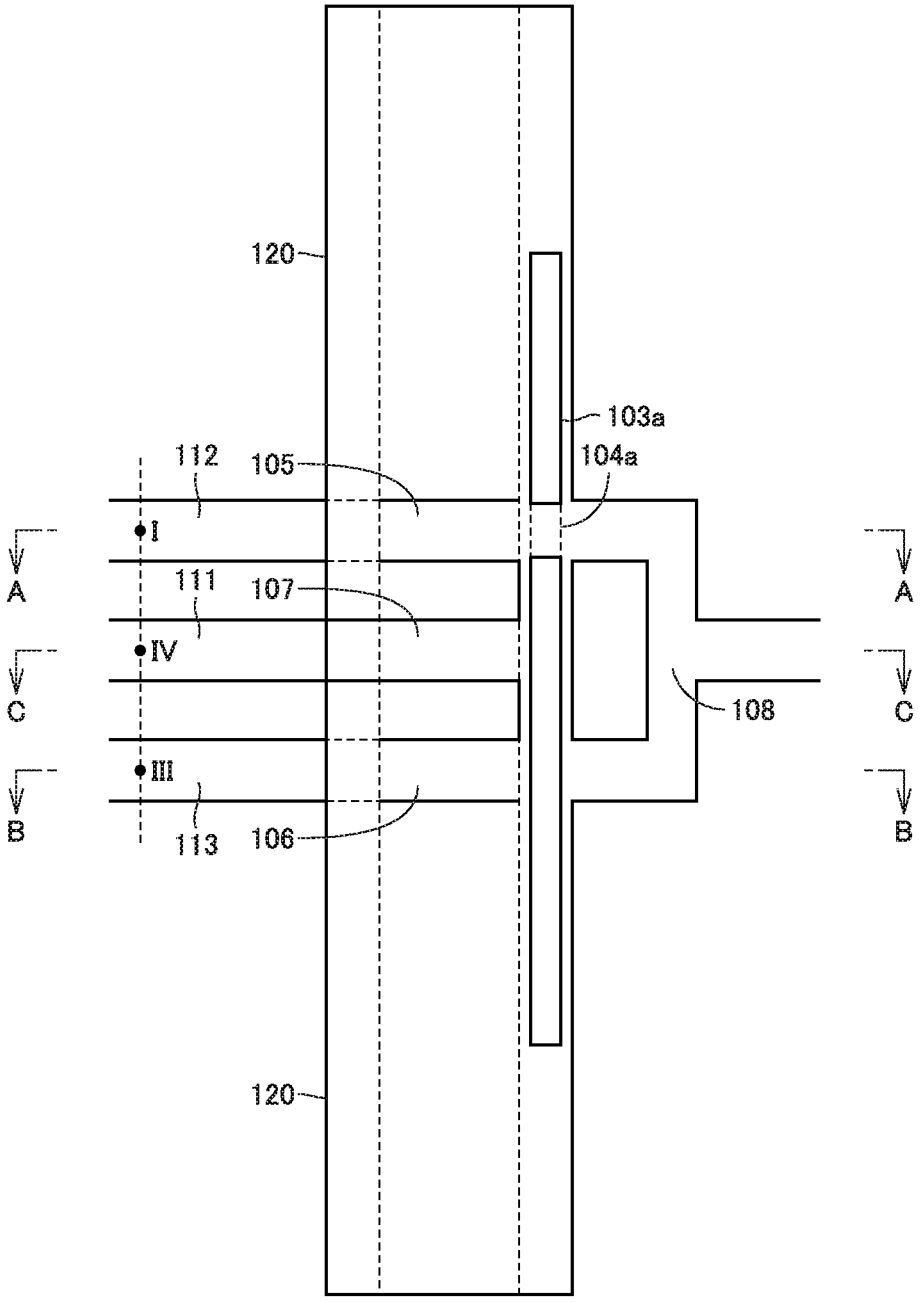
FIG. 13 is a longitudinal sectional schematic diagram of a flow path switching device in embodiment 2 of the present invention.
Figure 14:
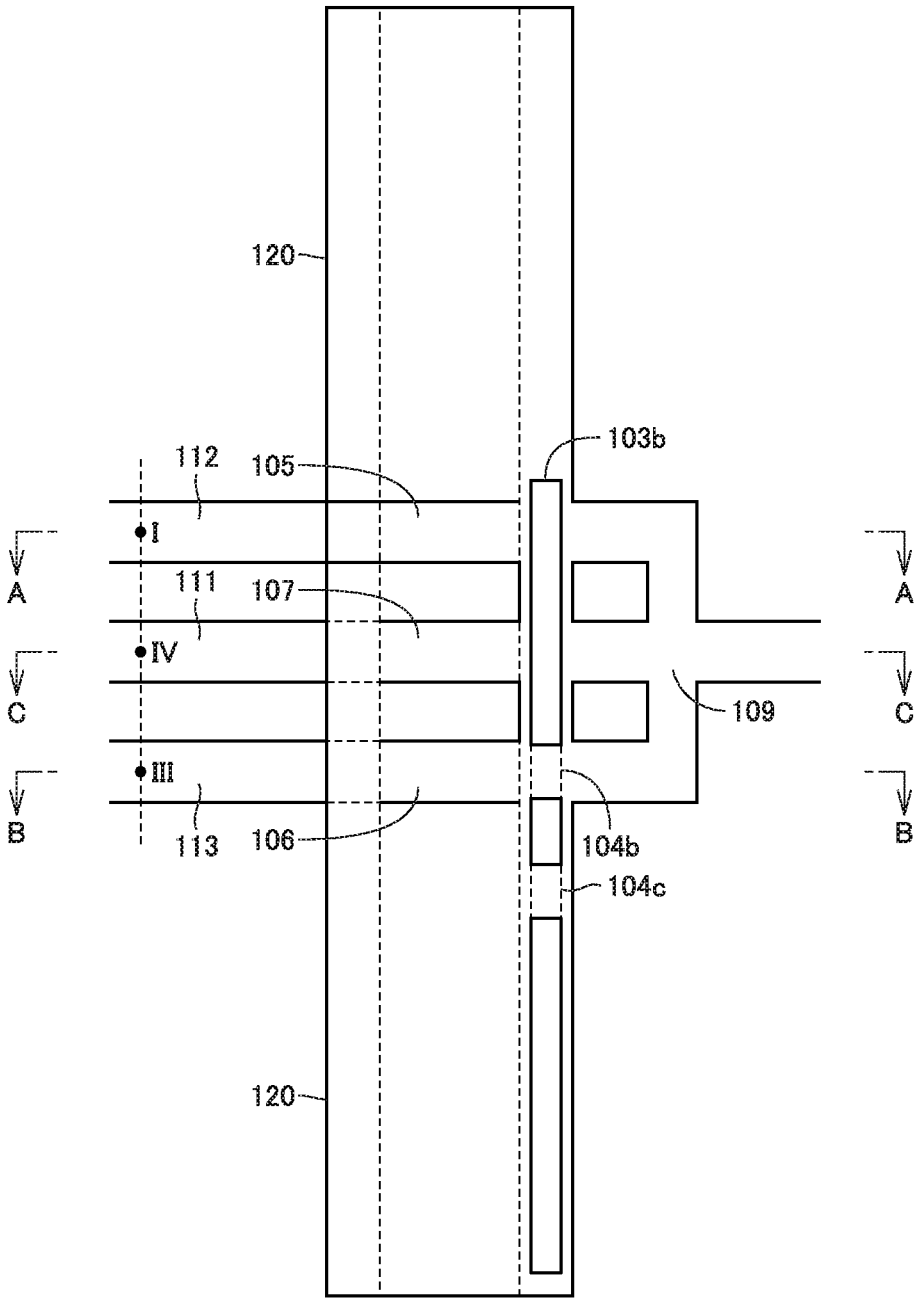
FIG. 14 is a longitudinal sectional schematic diagram of a flow path switching device in embodiment 2 of the present invention.
Figure 15:
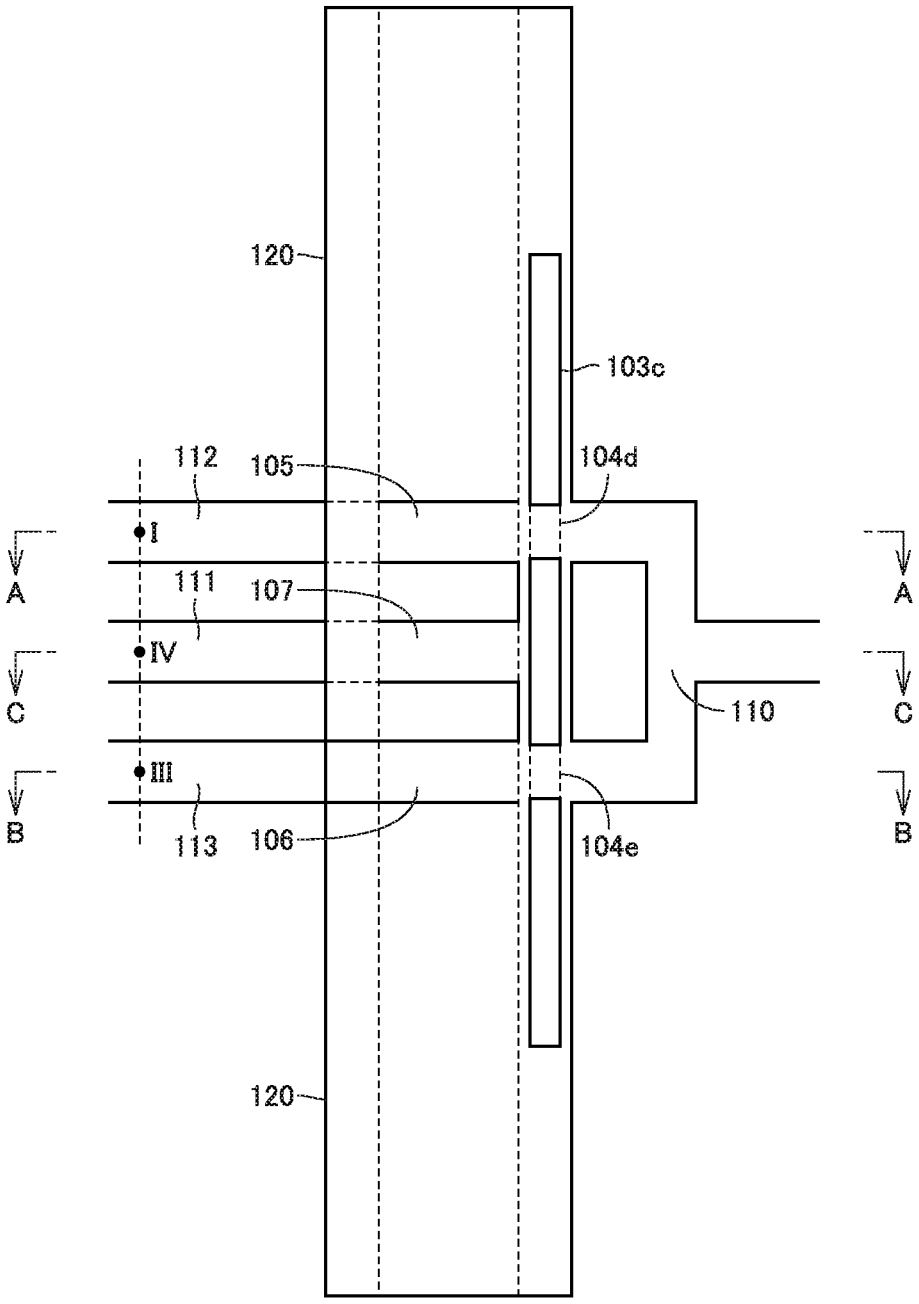
FIG. 15 is a longitudinal sectional schematic diagram of a flow path switching device in embodiment 2 of the present invention.

The configuration of a flow path switching device that constitutes an air conditioner according to the present embodiment is shown in FIG. 7 to FIG. 15 FIG. 7 and FIG. 8 are perspective schematic views of the flow path switching device according to the present embodiment. FIG. 9 to FIG. 11 are schematic diagrams of branch flow paths 108 to 110 that constitute the flow path switching device shown in FIG. 7 and FIG. 8. FIG. 12 is a transverse sectional schematic diagram of the flow path switching device according to the present embodiment. FIG. 13 to FIG. 15 are longitudinal sectional schematic diagrams of the flow path switching device according to the present embodiment. The air conditioner according to the present embodiment basically has the same configuration as the air conditioner shown in FIG. 1 to FIG. 6. However, the configuration of flow path switching device 12 is different from that of the air conditioner shown in FIG. 1 to FIG. 6. The configuration of the flow path switching device is hereinafter described.

As shown in FIG. 7 to FIG. 15, flow path switching device 12 includes casing 120 having branch flow paths 108 to 110 and pipes 111 to 113. The circumferential end of branch flow path 108 corresponds to second port II of flow path switching device 12. The circumferential end of branch flow path 109 corresponds to fifth port V of flow path switching device 12. The circumferential end of branch flow path 110 corresponds to sixth port VI of flow path switching device 12. The circumferential end of pipe 111 corresponds to fourth port IV of flow path switching device 12. The circumferential end of pipe 112 corresponds to first port I of flow path switching device 12. The circumferential end of pipe 113 corresponds to third port III of flow path switching device 12.

In flow path switching device 12, three flow paths 105 to 107 are stacked.

Branch flow path 108 is connected to flow path 105 and flow path 106 via changeover valve 103*a*. Branch flow path 109 is connected to all of flow paths 105, 106, 107 via changeover valve 103*b*. Branch flow path 110 is connected to flow paths 105, 106 via changeover valve 103*c*. Pipe 111 is connected to flow path 107. Pipe 112 is connected to flow path 105. Pipe 113 is connected to flow path 106. Changeover valve 103*a* is a rod-shaped body and has an opening 104*a* to serve as a refrigerant flow path. Changeover valve 103*b* is a rod-shaped body and has two openings 104*b*, 104*c* to serve as refrigerant flow paths. Changeover valve 103*c* is a rod-shaped body and has two openings 104*d*, 104*e* to serve as refrigerant flow paths.

Changeover valves 103*a* to 103*c* as first to third changeover valves are arranged slidably in the direction in which changeover valves 103*a* to 103*c* extend in flow path switching device 12. Each of changeover valves 103*a* to 103*c* is disposed in a slide hole formed at the connection portion between a corresponding one of branch flow paths 108 to 110 and flow paths 105 to 107. Changeover valves 103*a* to 103*c* can switch the status of connection between branch flow paths 108 to 110 and flow paths 105 to 107 by being slid and switching the positions of the above-described openings. As shown in FIG. 7 and FIG. 8, drive devices 121*a* to 121*c* for sliding changeover valves 103*a* to 103*c* are disposed on the top of casing 120 of flow path switching device 12. Drive devices 121*a* to 121*c* may have any configuration that can move changeover valves 103*a* to 103*c*. For example, a combination of an electric motor and a gear, or an actuator may be used. The internal structure of flow path switching device 12 is hereinafter described.

FIG. 12 and FIG. 13 show the cross-sectional structure of flow path switching device 12 including branch flow path 108. As shown in FIG. 13, flow path switching device 12 includes therein a stack of three independent refrigerant flow paths 105 to 107. In FIG. 16 to FIG. 19 described later, the flow path cross sections of the above-described refrigerant flow paths 105 to 107 are shown as cross-sectional schematic diagrams taken along cross sections A-A, B-B, C-C. The pipes from first port I, fourth port IV, and third port III respectively communicate with flow paths 105, 107, 106 in casing 120. Among changeover valves 103*a* to 103*c* included in flow path switching device 12, the changeover valve that relates to branch flow path 108 is changeover valve 103*a*. Changeover valve 103*a* has opening 104*a* to serve as a refrigerant flow path. Depending on the presence or absence of electric current for example, changeover valve 103*a* switches its position between the position in which opening 104*a* as a refrigerant flow path allows flow path 105 and branch flow path 108 to communicate, and the position in which opening 104*a* allows flow path 106 and branch flow path 108 to communicate.

Next, FIG. 14 shows the cross-sectional structure of flow path switching device 12 including branch flow path 109. Among changeover valves 103*a* to 103*c* included in flow path switching device 12, the changeover valve that relates to branch flow path 109 is changeover valve 103*b*. Changeover valve 103*b* has two openings 104*b*, 104*c* as refrigerant flow paths. Changeover valve 103*b* switches the positions of openings 104*b*, 104*c* as refrigerant flow paths by, for example, adjusting the electric current. For example, changeover valve 103*b* switches its position among the position in which opening 104*b* allows flow path 106 and branch flow path 109 to communicate, the position in which opening 104*c* allows flow path 105 and branch flow path 109 to communicate, and the position in which openings 104*b*, 104*c* as refrigerant flow paths respectively allow flow paths 107, 106 and branch flow path 109 to communicate.

Next, FIG. 15 shows the cross-sectional structure of flow path switching device 12 including branch flow path 110. Among changeover valves 103*a* to 103*c* included in flow path switching device 12, the changeover valve that relates to branch flow path 110 is changeover valve 103*c*. Changeover valve 103*c* has two openings 104*d*, 104*e* as refrigerant flow paths. Changeover valve 103*c* switches the positions of openings 104*d*, 104*e* by, for example, adjusting the electric current. Changeover valve 103*c* switches its position among the position in which opening 104*d* as a refrigerant flow path allows flow path 106 and branch flow path 110 to communicate, the position in which opening 104*e* as a refrigerant flow path allows flow path 105 and branch flow path 110 to communicate, and the position in which two openings 104*d*, 104*e* as refrigerant flow paths respectively allow flow paths 105, 106 and branch flow path 110 to communicate.

From a different viewpoint, flow path switching device 12 shown in FIG. 7 to FIG. 15 includes casing 120 and changeover valves 103*a* to 103*c* as first to third changeover valves. Casing 120 has first to sixth ports I to VI. Changeover valve 103*a* as a first changeover valve switches the connection target of second port II between first port I and third port III, as shown in FIG. 13. Changeover valve 103*b* as a second changeover valve switches the connection target of fifth port V among first port I, third port III, and fourth port IV, as shown in FIG. 14. Changeover valve 103*c* as a third changeover valve switches the connection target of sixth port VI between first port I and third port III, as shown in FIG. 15.

<Operation and Advantageous Effects of Air Conditioner>

The operation of the air conditioner according to the present embodiment is basically the same as that of the air conditioner shown in FIG. 1 to FIG. 6. In the present embodiment, however, the specific configuration of flow path switching device 12 is different from that of the air conditioner shown in FIG. 1 to FIG. 6. Hereinafter, the specific operation of the flow path switching device is mainly described with reference to FIG. 16 to FIG. 19. In FIG. 16 to FIG. 19, the A-A cross section in FIG. 13 to FIG. 15 is shown as (A), the C-C cross section in FIG. 13 to FIG. 15 is shown as (B), and the B-B cross section in FIG. 13 to FIG. 15 is shown as (C). In FIG. 16 to FIG. 19, the flow of refrigerant is indicated by arrows.

(1) During Heating Operation

Figure 16:
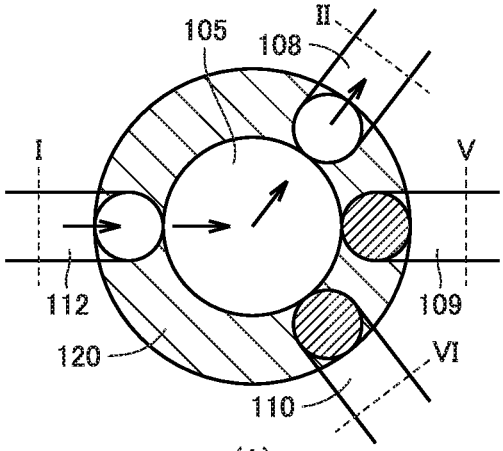
FIG. 16 is a transverse sectional schematic diagram for explaining the state during a heating operation of a flow path switching device in embodiment 2 of the present invention.
Figure 16:
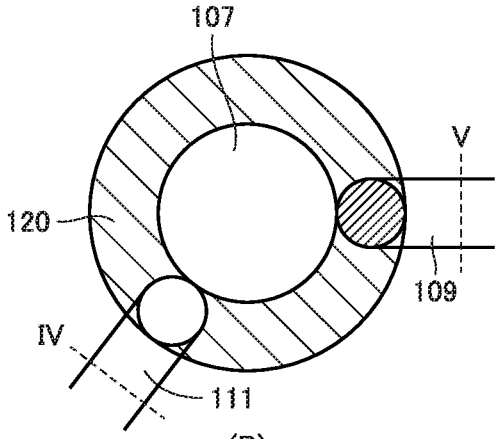
Figure 16:
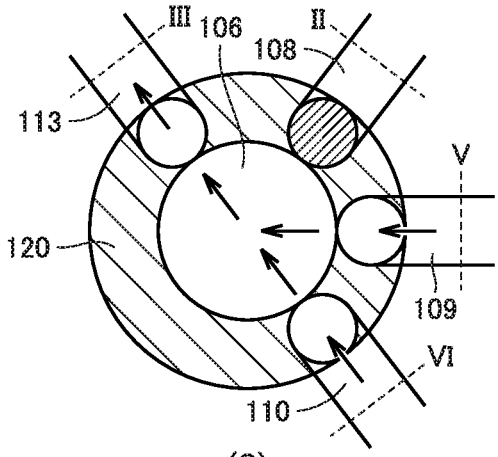

FIG. 16 shows a refrigerant flow in flow path switching device 12 during a heating operation in the air conditioner. In the A-A cross section shown in FIG. 16 (A), refrigerant flows from first port I to second port II through pipe 112, flow path 105, and branch flow path 108, as indicated by the arrows. In the C-C cross section shown in FIG. 16 (B), refrigerant does not flow because the connection between flow path 107 and branch flow path 109 is broken by changeover valve 103*b* (see FIG. 14). In the B-B cross section shown in FIG. 16 (C), refrigerant flows from fifth port V and sixth port VI to third port III through branch flow paths 109, 110, flow path 106, and pipe 113.

(2) During Cooling Operation

Figure 17:
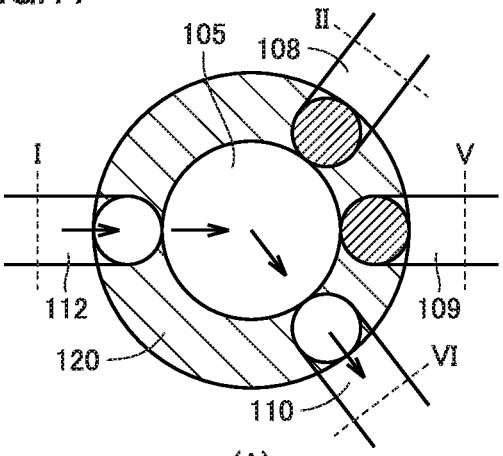
FIG. 17 is a transverse sectional schematic diagram for explaining the state during a cooling operation of a flow path switching device in embodiment 2 of the present invention.
Figure 17:
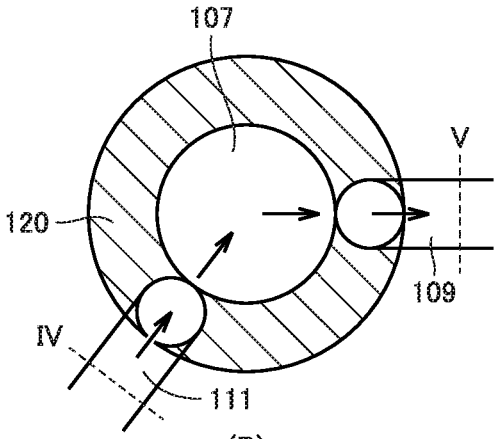
Figure 17:
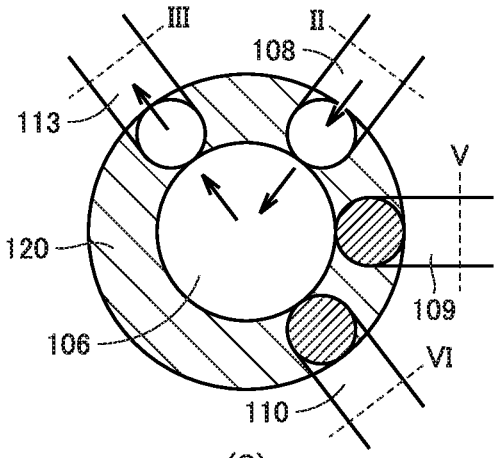

FIG. 17 shows a refrigerant flow in flow path switching device 12 during a cooling operation in the air conditioner. In the A-A cross section shown in FIG. 17 (A), refrigerant flows from first port I to sixth port VI through pipe 112, flow path 105, and branch flow path 110, as indicated by the arrows. In the C-C cross section shown in FIG. 17 (B), refrigerant flows from fourth port IV to fifth port V through pipe 111, flow path 107, and branch flow path 109. In the B-B cross section shown in FIG. 17 (C), refrigerant flows from second port II to third port III through branch flow path 108, flow path 106, and pipe 113.

(3) Heating-Defrosting Operation

Figure 18:
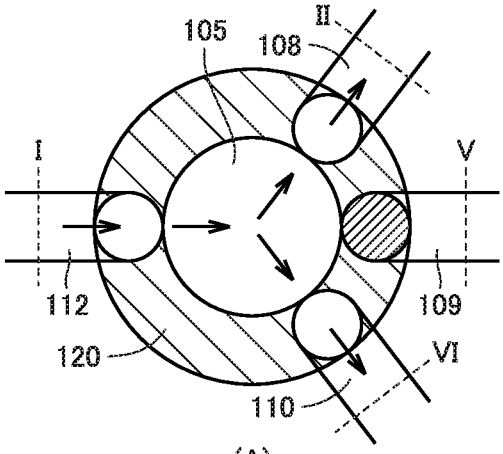
FIG. 18 is a transverse sectional schematic diagram for explaining the state during a heating-defrosting simultaneous operation of a flow path switching device in embodiment 2 of the present invention.
Figure 18:
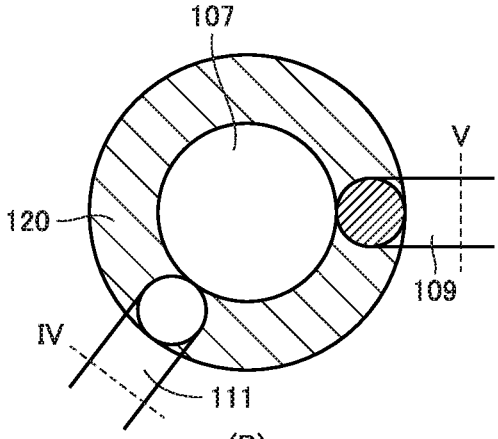
Figure 18:
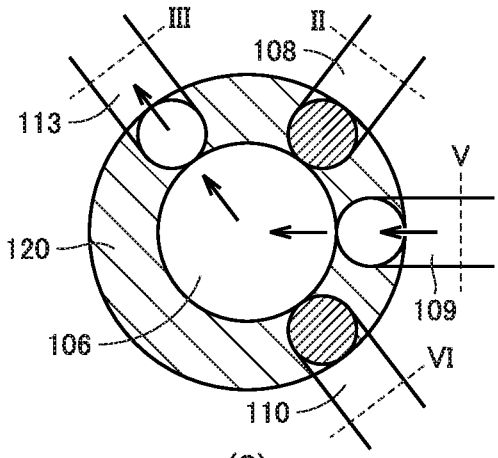

FIG. 18 shows a refrigerant flow in flow path switching device 12 during a heating continuous operation (pattern 1) in the air conditioner. In the A-A cross section shown in FIG. 18 (A), refrigerant flows from first port I to second port II and sixth port VI through pipe 112, flow path 105, and branch flow paths 108, 110, as indicated by the arrows. In the C-C cross section shown in FIG. 18 (B), refrigerant does not flow because the connection between flow path 107 and branch flow path 109 is broken by changeover valve 103*b* (see FIG. 14). In the B-B cross section shown in FIG. 18 (C), refrigerant flows from fifth port V to third port III through branch flow path 109, flow path 106, and pipe 113.

Figure 19:
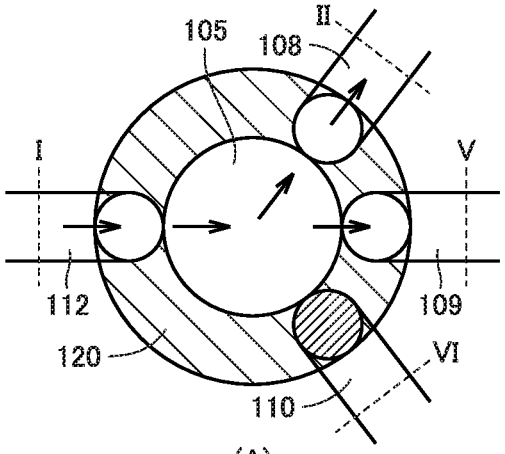
FIG. 19 is a transverse sectional schematic diagram for explaining the state during a heating-defrosting simultaneous operation of a flow path switching device in embodiment 2 of the present invention.
Figure 19:
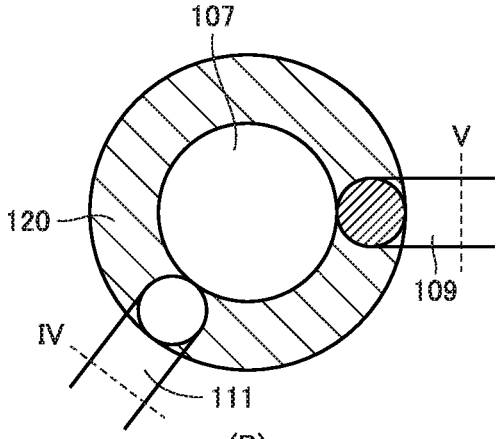
Figure 19:
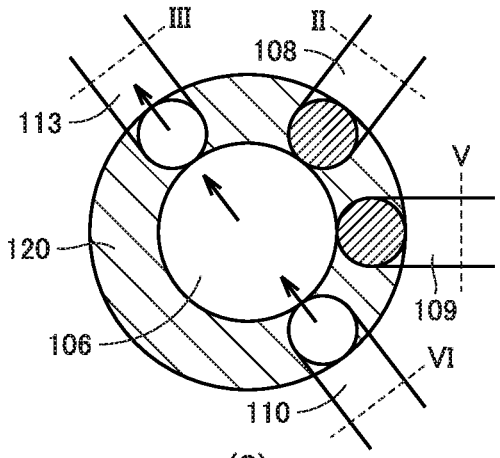

FIG. 19 shows a refrigerant flow in flow path switching device 12 during a heating continuous operation (pattern 2) in the air conditioner. In the A-A cross section shown in FIG. 19 (A), refrigerant flows from first port I to second port II and fifth port V through pipe 112, flow path 105, and branch flow paths 108, 109, as indicated by the arrows. In the C-C cross section shown in FIG. 19 (B), refrigerant does not flow because the connection between flow path 107 and branch flow path 109 is broken by changeover valve 103*b* (see FIG. 14). In the B-B cross section shown in FIG. 19 (C), refrigerant flows from sixth port VI to third port III through branch flow path 110, flow path 106, and pipe 113.

Using refrigerant flow path switching circuit 101 with flow path switching device 12 as described above, reductions in manufacturing cost and space for the flow path switching device are achieved by reducing the numbers of valves and routed pipes in flow path switching device 12 compared with embodiment 1.

Embodiment 3

<Configuration of Air Conditioner>

FIG. 20 to FIG. 23 are configuration diagrams showing the configuration of a flow path switching device that constitutes an air conditioner according to the present embodiment. FIG. 20 to FIG. 23 show the states of the flow path switching device during a heating operation, during a cooling operation, during a heating continuous operation (pattern 1), and during a heating continuous operation (pattern 2), respectively. The air conditioner according to the present embodiment basically has the same configuration as that of the air conditioner shown in FIG. 1 to FIG. 6. The configuration of flow path switching device 12, however, is different from that of the air conditioner shown in FIG. 1 to FIG. 6. The configuration of the flow path switching device is hereinafter described.

Flow path switching device 12 that constitutes the refrigerant flow path switching circuit in the present embodiment shown in FIG. 20 to FIG. 23 has a simple configuration using existing components. That is, flow path switching device 12 in the present embodiment includes at least one or more four-way valve 31 and three or more three-way valves 32 to 34. Four-way valve 31 is connected to three-way valves 32 to 34 with pipes. Specific explanation is given hereinafter.

Figure 21:
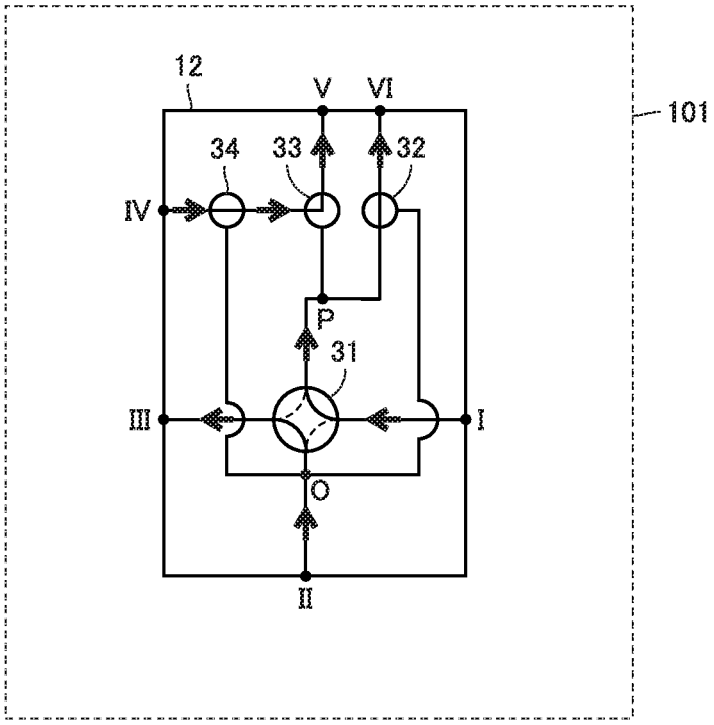
FIG. 21 is a configuration diagram showing the state during a cooling operation of a flow path switching device in embodiment 3 of the present invention.
Figure 22:
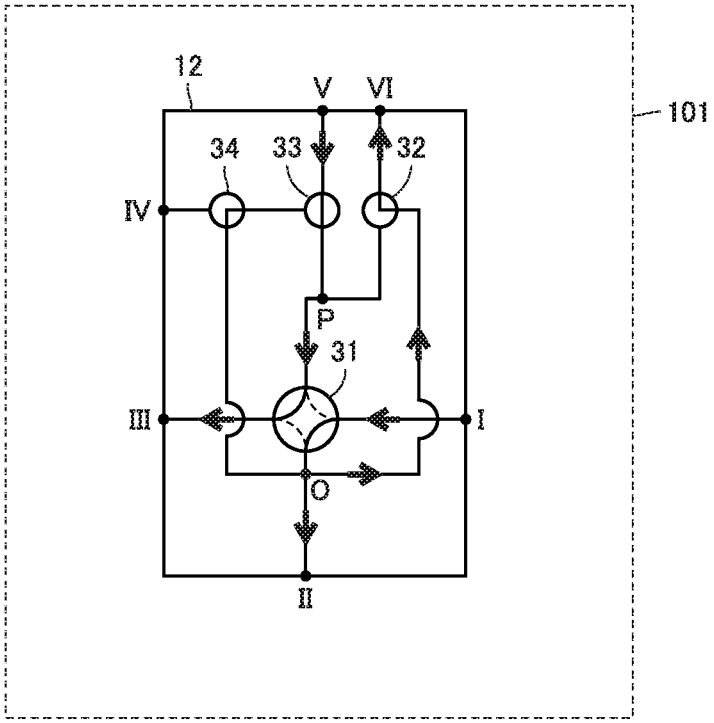
FIG. 22 is a configuration diagram showing the state during a heating-defrosting simultaneous operation of a flow path switching device in embodiment 3 of the present invention.

As shown in FIG. 22, flow path switching device 12 includes first to sixth ports I to VI formed on a casing, pipes that connect first to sixth ports I to VI with each other, and one four-way valve 31 and three three-way valves 32 to 34 placed on pipes. First port I is connected to four-way valve 31. Second port II is connected to four-way valve 31 via point O. Second port II is connected to three-way valve 34 via point O. Second port II is connected to three-way valve 32 via point O. Third port III is connected to four-way valve 31. Fourth port IV is connected to fifth port V with pipes via three-way valve 34 and three-way valve 33. Fifth port V is connected to four-way valve 31 via three-way valve 33 and point P. Sixth port VI is connected to four-way valve 31 via three-way valve 32 and point P. Using flow path switching device 12 with such a configuration, the operation states shown in FIG. 20 to FIG. 23 can be provided.

<Operation and Advantageous Effects of Air Conditioner>

(1) During Heating Operation

Figure 20:
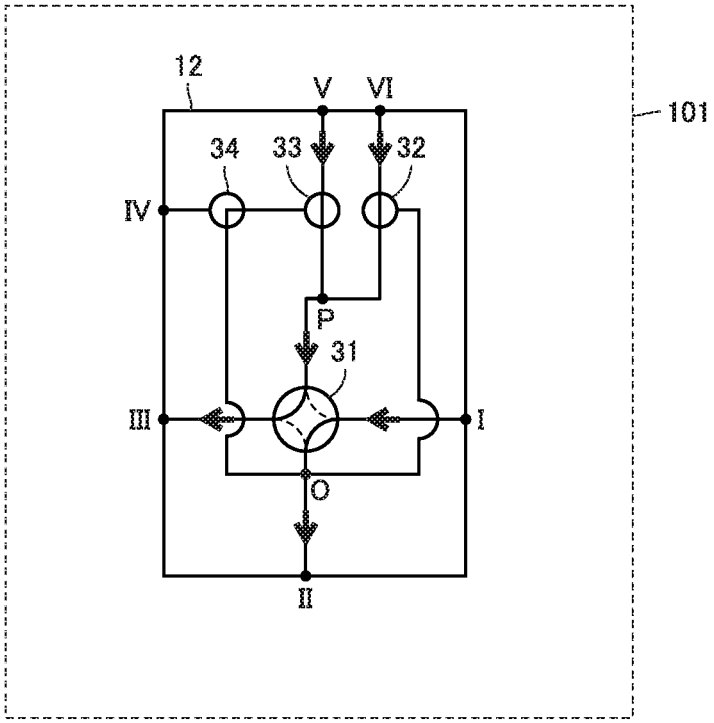
FIG. 20 is a configuration diagram showing the state during a heating operation of a flow path switching device in embodiment 3 of the present invention.

FIG. 20 shows a refrigerant flow in flow path switching device 12 during a heating operation in the air conditioner. Refrigerant from first port I passes through four-way valve 31 and flows to second port II. Refrigerant from fifth port V and refrigerant from sixth port VI pass through three-way valves 33, 32, respectively, and join together at point P. The joined refrigerant passes through four-way valve 31 and flows to third port III. A flow path from fourth port IV is blocked by three-way valve 34 and thus does not cause a flow. In this way, the heating operation is performed in the air conditioner in the present embodiment.

(2) During Cooling Operation

FIG. 21 shows a refrigerant flow in flow path switching device 12 during a cooling operation in the air conditioner. Refrigerant from first port I passes through four-way valve 31, point P, and three-way valve 32 and flows to sixth port VI. Refrigerant from fourth port IV passes through three-way valve 34 and three-way valve 33 and flows to fifth port V. Refrigerant from second port II passes through four-way valve 31 and flows to third port III. In this way, the cooling operation is performed in the air conditioner in the present embodiment.

(3) During Heating-Defrosting Operation

FIG. 22 shows a refrigerant flow in flow path switching device 12 during a heating continuous operation (pattern 1) in the air conditioner. Refrigerant from first port I passes through four-way valve 31. Then, a part of the refrigerant flows to second port II, and the remaining part passes through point O and three-way valve 32 and flows to sixth port VI. Refrigerant from fifth port V passes through three-way valve 33, point P, and four-way valve 31 and flows to third port III. A flow path from fourth port IV is blocked by three-way valve 34 and thus does not cause a flow. In this way, the heating continuous operation (pattern 1) is performed in the air conditioner in the present embodiment.

Figure 23:
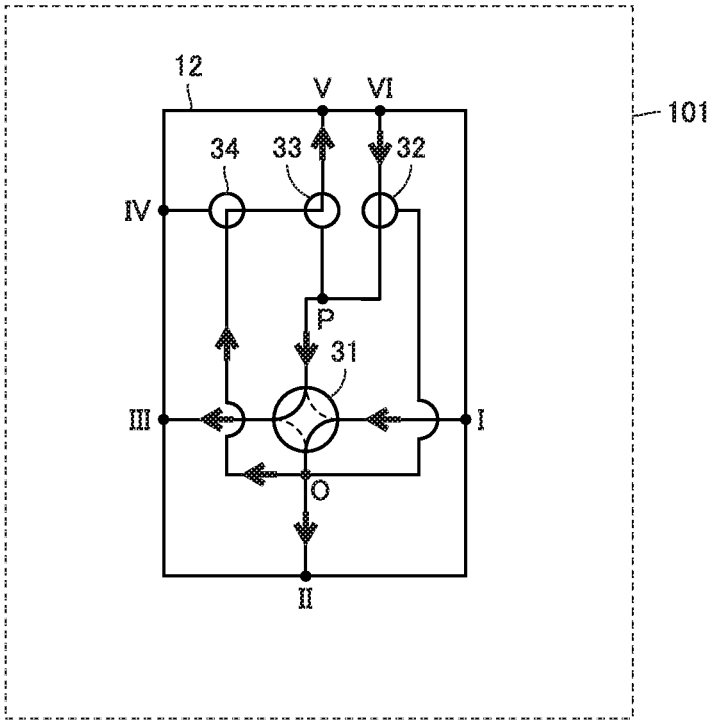
FIG. 23 is a configuration diagram showing the state during a heating-defrosting simultaneous operation of a flow path switching device in embodiment 3 of the present invention.

FIG. 23 shows a refrigerant flow in flow path switching device 12 during a heating continuous operation (pattern 2) in the air conditioner. Refrigerant from first port I passes through four-way valve 31 and point O. Then, a part of the refrigerant flows to second port II, and the remaining part passes through three-way valve 34 and three-way valve 33 and flows to fifth port V. Refrigerant from sixth port VI passes through three-way valve 32, point P, and four-way valve 31 and flows to third port III. A flow path from fourth port IV is blocked by three-way valve 34 and thus does not cause a flow. In this way, the heating continuous operation (pattern 2) is performed in the air conditioner in the present embodiment. With the configuration of flow path switching device 12 as described above, it is possible for flow path switching device 12 to have a simple configuration using existing components. Thus, the air conditioner according to the present embodiment can be easily provided.

Embodiment 4

Figure 24:
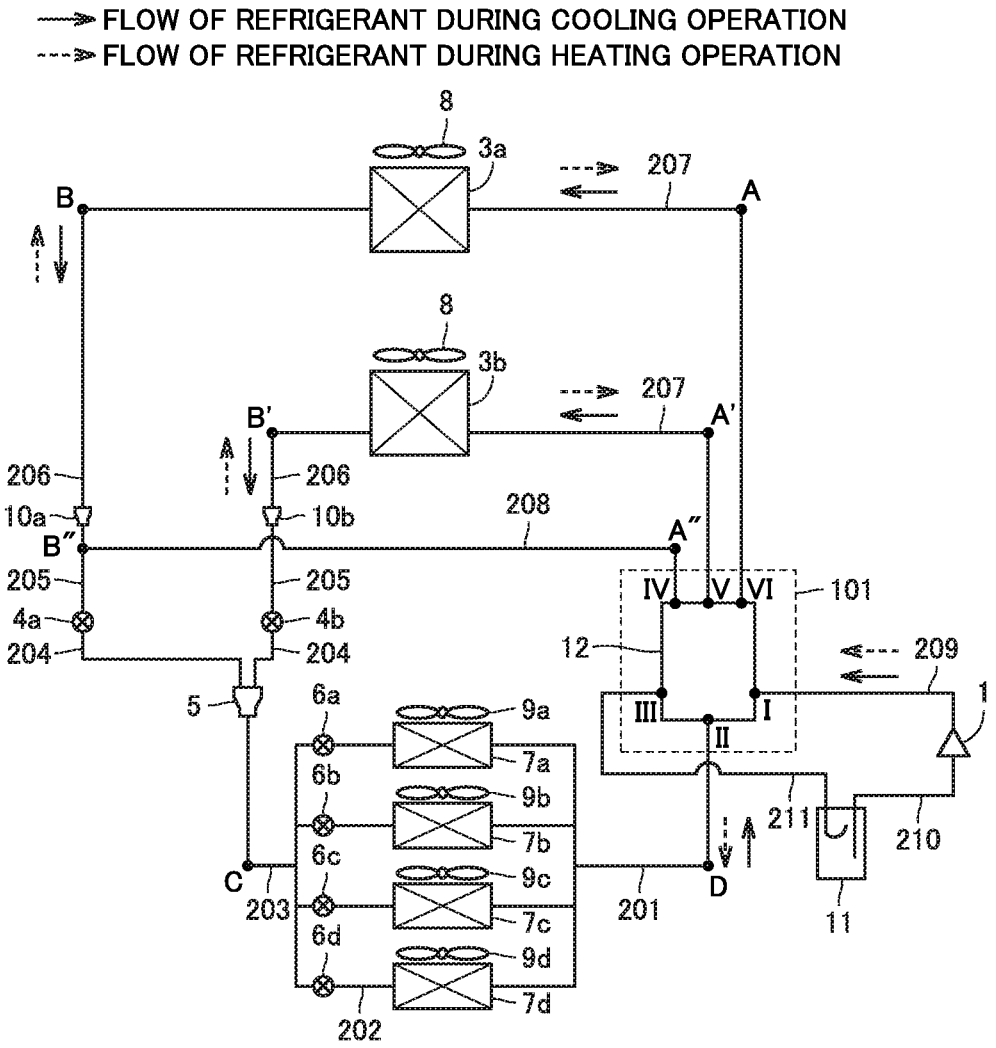
FIG. 24 is a configuration diagram showing the configuration of an air conditioner in embodiment 4 of the present invention.

FIG. 24 is a configuration diagram showing the configuration of an air conditioner according to the present embodiment. The air conditioner shown in FIG. 24 basically has the same configuration as the air conditioner shown in FIG. 1 to FIG. 6. However, it is different from the air conditioner shown in FIG. 1 to FIG. 6 in that outdoor fan 8 is provided as a first fan to send air to outdoor heat exchanger 3*a* (first refrigerant flow path), and in that outdoor fan 8 is provided as a second fan to send air to outdoor heat exchanger 3*b* (second refrigerant flow path). Outdoor heat exchangers 3*a*, 3*b* are independent outdoor heat exchangers each having outdoor fan 8.

Such a configuration brings about the same advantageous effects as those of the air conditioner shown in FIG. 1 to FIG. 6. The configuration of flow path switching device 12 shown in FIG. 24 may be any of the above described configurations of embodiments 1 to 3.

Figure 25:
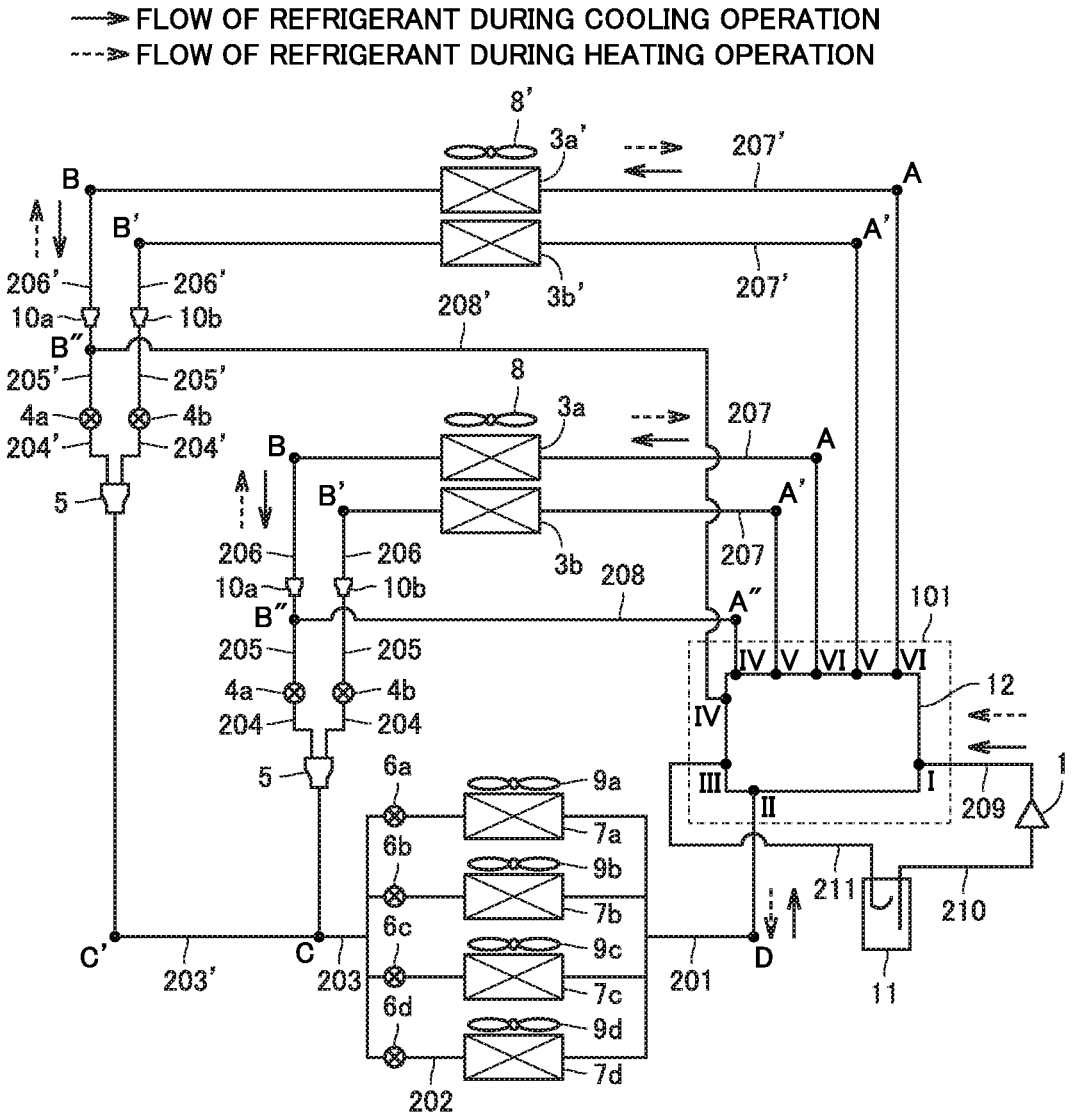
FIG. 25 is a configuration diagram showing the configuration of a variation of the air conditioner in embodiment 4 of the present invention.

FIG. 25 is a configuration diagram showing the configuration of a variation of the air conditioner according to the present embodiment. The air conditioner shown in FIG. 25 basically has the same configuration as the air conditioner shown in FIG. 1 to FIG. 6. However, it is different from the air conditioner shown in FIG. 1 to FIG. 6 in that additional outdoor heat exchangers 3*a*', 3*b*', in addition to outdoor heat exchangers 3*a*, 3*b* shown in FIG. 1 to FIG. 6, are connected to the refrigerant circuit. Further, the configuration of flow path switching device 12 is different from that of the air conditioner shown in FIG. 1 to FIG. 6.

In the air conditioner shown in FIG. 25, expansion valves 6*a* to 6*d* are connected to second three-way tube 5 via pipe 203, point C, pipe 203', and point C', in addition to the configuration of the air conditioner shown in FIG. 1 to FIG. 6. Second three-way tube 5 as another branch point is connected to second expansion valves 4*a*, 4*b* via pipes 204'. Second expansion valve 4*a* is connected to second refrigerant distributor 10*a* via pipe 205'. Pipe 205' has second connection point B" at which pipe 205' and pipe 208' are connected. Second refrigerant distributor 10*a* is connected to additional outdoor heat exchanger 3*a*' via pipe 206'. Second expansion valve 4*b* is connected to second refrigerant distributor 10*b* via pipe 205'. Second refrigerant distributor 10*b* is connected to additional outdoor heat exchanger 3*b*' via pipe 206'.

Flow path switching device 12 has additional fourth port IV as a seventh port, additional fifth port V as an eighth port, and additional sixth port VI as a ninth port, in addition to first to sixth ports I to VI. Pipe 208' is connected to additional fourth port IV. Additional outdoor heat exchanger 3*a*' is connected to additional sixth port VI via pipe 207'. Additional outdoor heat exchanger 3*b*' is connected to additional fifth port V via pipe 207'.

As to additional fourth to sixth ports IV to VI, the connection target is switchable in the same manner as the switching among fourth to sixth ports IV to VI in flow path switching device 12 in the air conditioner shown in FIG. 1 to FIG. 6.

Figure 26:
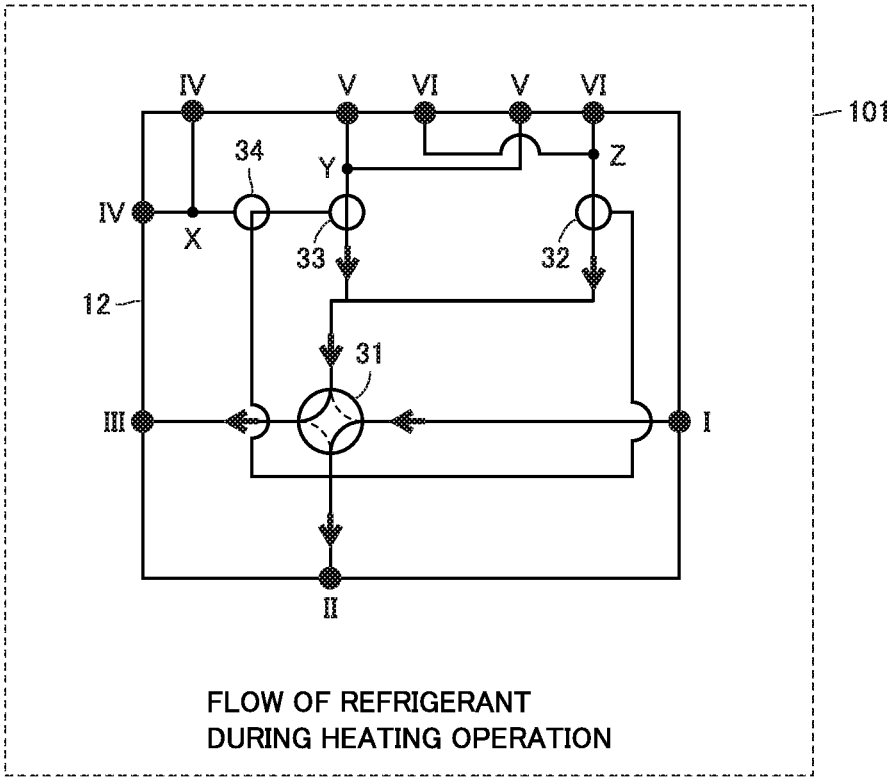
FIG. 26 is a configuration diagram showing the state during a heating operation of a flow path switching device in a variation of the air conditioner in embodiment 4 of the present invention.

An example of a specific configuration of flow path switching device 12 shown in FIG. 25 is described with reference to FIG. 26. FIG. 26 is a schematic diagram of a refrigerant flow that satisfies the operation state corresponding to the heating operation in embodiment 3 shown in FIG. 20. FIG. 26 includes point X, point Y, and point Z for two fourth ports IV, two fifth ports V, and two sixth ports VI shown in FIG. 25, respectively, at each of which points the pipe path divides into two branches in flow path switching device 12. Each of point X, point Y, and point Z equally divides refrigerant into two branches, thus allowing outdoor heat exchanger 3*a* and additional outdoor heat exchanger 3*a*' to operate in the same refrigerant state, and allowing outdoor heat exchanger 3*b* and additional outdoor heat exchanger 3*b*' to operate in the same refrigerant state. Thus, the same advantageous effects as those of the air conditioner according to embodiment 3 of the present invention can be achieved. As in flow path switching device 12 shown in FIG. 26, flow path switching device 12 that constitutes the air conditioner in embodiments 1, 2 may also have additional fourth to sixth ports IV to VI. In this case, the same operation as that of flow path switching device 12 shown in FIG. 26 can be provided by providing point X, point Y, and point Z for two fourth ports IV, two fifth ports V, and two sixth ports VI, respectively, at each of which points the pipe path divides into two branches in flow path switching device 12.

The distinctive features of the air conditioner shown in the above-described FIG. 25 and FIG. 26 are summarized as follows. The second heat exchanger includes additional outdoor heat exchanger 3*a*' as a third refrigerant flow path, and additional outdoor heat exchanger 3*b*' as a fourth refrigerant flow path. The third refrigerant flow path (additional outdoor heat exchanger 3*a*') and the fourth refrigerant flow path (additional outdoor heat exchanger 3*b*') are connected in parallel to the first heat exchanger (indoor heat exchangers 7*a* to 7*d*) via second three-way tube 5 as another branch point. Flow path switching device 12 includes the seventh to ninth ports (additional fourth to sixth ports IV to VI). The seventh port (additional fourth port IV) is connected to other pipes 204' to 206' that connect another branch point (second three-way tube 5) to the third refrigerant flow path (additional outdoor heat exchanger (3*a*'). The eighth port (additional fifth port V) is connected to the fourth refrigerant flow path (additional outdoor heat exchanger 3*b*'). The ninth port (additional sixth port VI) is connected to the third refrigerant flow path (additional outdoor heat exchanger 3*a*'). In flow path switching device 12, fourth port IV and the seventh port (additional fourth port IV), connected to each other at point X as shown in FIG. 26, constitute a first port group. Fifth port V and the eighth port (additional fifth port V), connected to each other at point Y, constitute a second port group. Sixth port VI and the ninth port (additional sixth port VI), connected to each other at point Z, constitute a third port group. The connection target of the second port group is switchable among first port I, third port III, and the first port group. The connection target of the third port group is switchable between first port I and third port III.

If each of the two outdoor heat exchangers (second heat exchangers) includes a plurality of refrigerant flow paths (e.g. outdoor heat exchangers 3*a*, 3*b* or outdoor heat exchangers 3*a*', 3*b*') as shown in FIG. 25, a plurality of fourth ports IV, fifth ports V, and sixth ports VI may be formed in flow path switching device 12 as described above in accordance with the number of second heat exchangers. Further, flow path switching device 12 can include an unlimited number of outdoor heat exchangers by increasing the number of branches at point X, point Y, and point Z in accordance with the number of additional second heat exchangers in flow path switching device 12.

Further, an additional outdoor heat exchanger (second heat exchanger), added to the configuration shown in FIG. 1 to FIG. 6 for example, is connected to the refrigerant circuit in the same manner as the outdoor heat exchanger shown in FIG. 1 to FIG. 6. Such a configuration can bring about the same advantageous effects as those of the air conditioner shown in FIG. 1 to FIG. 6. An air conditioner as a refrigeration cycle apparatus as shown in FIG. 25, in particular, can perform a heating continuous operation in which two divided outdoor heat exchangers 3*a*, 3*b* in a single outdoor heat exchanger (second heat exchanger) carry out different functions. That is, with a plurality of outdoor heat exchangers, embodiments 1 to 3 of the present invention can still bring about the above-described advantageous effects, as is apparent from the foregoing.

The embodiments of the present invention described above may be modified in various ways. The scope of the present invention is not limited to the above-described embodiments. The scope of the present invention is defined by the terms of the claims and is intended to include any modification within the meaning and the scope equivalent to the terms of the claims.

INDUSTRIAL APPLICABILITY

The present invention is applicable to, for example, heat pump equipment, a water heater, a refrigerator, and the like.

The invention claimed is:

1. An air conditioner comprising a refrigerant circuit through which refrigerant circulates, the refrigerant circuit including a compressor, a first heat exchanger, an expansion valve, a second heat exchanger, and a flow path switching device, the second heat exchanger including a first refrigerant flow path and a second refrigerant flow path, the compressor including an intake portion and a discharge portion, the first refrigerant flow path and the second refrigerant flow path being connected in parallel to the first heat exchanger via a branch point, the flow path switching device including a first port connected to the discharge portion of the compressor, a second port connected to the first heat exchanger, a third port connected to the intake portion of the compressor, a fourth port connected to a pipe that connects the branch point to the first refrigerant flow path, a fifth port connected to the second refrigerant flow path, and a sixth port connected to the first refrigerant flow path, in the flow path switching device, a connection target of the second port being switchable between the first port and the third port, a connection target of the fifth port being switchable among the first port, the third port, and the fourth port, a connection target of the sixth port being switchable between the first port and the third port.

2. The air conditioner according to claim 1, wherein the expansion valve is placed between a connection point and the branch point on the pipe, the connection point being connected to the fourth port.

3. The air conditioner according to claim 2, wherein the air conditioner is operable in a first operation state in which the expansion valve is in an open state, and in the flow path switching device, the first port is connected to the second port, and the fifth port and the sixth port are connected to the third port.

4. The air conditioner according to claim 1, wherein the air conditioner is operable in a second operation state in which the expansion valve is in a closed state, and in the flow path switching device, the first port is connected to the sixth port, the second port is connected to the third port, and the fourth port is connected to the fifth port.

5. The air conditioner according to claim 1, wherein the air conditioner is operable in a third operation state in which the expansion valve is in an open state, and in the flow path switching device, the first port is connected to the second port and the sixth port, and the third port is connected to the fifth port.

6. The air conditioner according to claim 1, wherein the air conditioner is operable in a fourth operation state in which the expansion valve is in an open state, and in the flow path switching device, the first port is connected to the second port and the fifth port, and the third port is connected to the sixth port.

7. The air conditioner according to claim 1, wherein the flow path switching device includes three or more openable and closable valves.

8. The air conditioner according to claim 1, wherein the flow path switching device includes at least one or more four-way valve and three or more three-way valves.

9. The air conditioner according to claim 1, wherein the flow path switching device includes a casing having the first to sixth ports, a first changeover valve configured to switch a connection target of the second port between the first port and the third port, a second changeover valve configured to switch a connection target of the fifth port among the first port, the third port, and the fourth port, and a third changeover valve configured to switch a connection target of the sixth port between the first port and the third port.

10. The air conditioner according to claim 1, further comprising:

a first fan configured to send air to the first refrigerant flow path; and a second fan configured to send air to the second refrigerant flow path.

11. The air conditioner according to claim 1, wherein the second heat exchanger includes a third refrigerant flow path and a fourth refrigerant flow path, the third refrigerant flow path and the fourth refrigerant flow path are connected in parallel to the first heat exchanger via another branch point, the flow path switching device includes a seventh port connected to another pipe that connects the other branch point to the third refrigerant flow path, an eighth port connected to the fourth refrigerant flow path, and a ninth port connected to the third refrigerant flow path, and in the flow path switching device, the fourth port and the seventh port connected to each other constitute a first port group, the fifth port and the eighth port connected to each other constitute a second port group, the sixth port and the ninth port connected to each other constitute a third port group, a connection target of the second port group is switchable among the first port, the third port, and the first port group, and a connection target of the third port group is switchable between the first port and the third port.

* * * * *